US008760042B2

(12) United States Patent
Sakai et al.

(10) Patent No.: US 8,760,042 B2
(45) Date of Patent: Jun. 24, 2014

(54) LIGHTING DEVICE HAVING A THROUGH-HOLE AND A GROOVE PORTION FORMED IN THE THERMALLY CONDUCTIVE MAIN BODY

(75) Inventors: Makoto Sakai, Kanagawa-Ken (JP); Shigeru Osawa, Kanagawa-Ken (JP); Yusuke Shibahara, Kanagawa-Ken (JP); Takeshi Hisayasu, Tokyo (JP); Kazuto Morikawa, Kanagawa-Ken (JP); Tomohiro Sanpei, Kanagawa-Ken (JP); Erika Takenaka, Kanagawa-Ken (JP)

(73) Assignee: Toshiba Lighting & Technology Corporation, Kanagawa (JP)

( * ) Notice: Subject to any disclaimer, the term of this patent is extended or adjusted under 35 U.S.C. 154(b) by 142 days.

(21) Appl. No.: 12/713,230

(22) Filed: Feb. 26, 2010

(65) Prior Publication Data

US 2010/0219735 A1 Sep. 2, 2010

(30) Foreign Application Priority Data

Feb. 27, 2009 (JP) ..... 2009-046121
Jun. 30, 2009 (JP) ..... 2009-156100

(51) Int. Cl.
*H01J 61/52* (2006.01)

(52) U.S. Cl.
USPC ..... 313/46; 313/324; 313/51

(58) Field of Classification Search
USPC ..... 313/324, 51, 46
See application file for complete search history.

(56) References Cited

U.S. PATENT DOCUMENTS 1,972,790 A 9/1934 Olley
4,355,853 A 10/1982 Kourimsky (Continued)

FOREIGN PATENT DOCUMENTS

CN 1264152 8/2000
CN 1380704 11/2002

(Continued)

OTHER PUBLICATIONS

Search Report of International Application No. PCT/JP2008/068625 mailed Dec. 9, 2008.

(Continued)

*Primary Examiner* — Nimeshkumar Patel
*Assistant Examiner* — Jacob R Stern
(74) *Attorney, Agent, or Firm* — DLA Piper LLP (US)

(57) ABSTRACT

A lighting device and a lighting fixture of the embodiment of the present invention comprises a thermally conductive main body having a substrate support portion in one end portion, and having a through-hole and a groove portion formed in the substrate support portion, the through-hole penetrating from the one end portion to the other end portion of the main body, the groove portion extending continuously from the through-hole, a substrate mounted with a semiconductor light-emitting device, and disposed on the substrate support portion, an electrical connector connected to the semiconductor light-emitting device, a power supply device housed in the main body and configured to light the semiconductor light-emitting device, a wire connected to the power supply device and to the electrical connector while being inserted through the through-hole and the groove portion, and a base member provided in the other end portion of the main body and connected to the power supply device. Therefore, a lighting device and a lighting fixture of this embodiment of the present invention reduced in size, is configured to be suitable for mass production and is capable of producing a certain luminous flux.

21 Claims, 10 Drawing Sheets

(56) References Cited

U.S. PATENT DOCUMENTS 4,503,360 A 3/1985 Bedel
4,630,182 A 12/1986 Moroi
4,939,420 A 7/1990 Lim
5,323,271 A 6/1994 Shimada
5,327,332 A 7/1994 Hafemeister
D356,107 S 3/1995 Watanabe et al.
5,537,301 A 7/1996 Martich
5,556,584 A 9/1996 Yamazaki
5,585,697 A 12/1996 Cote
5,607,228 A 3/1997 Ozaki et al.
5,632,551 A 5/1997 Roney
5,685,628 A 11/1997 Feger et al.
5,775,792 A 7/1998 Wiese
5,785,418 A 7/1998 Hochstein
5,857,767 A 1/1999 Hochstein
5,947,588 A 9/1999 Huang
6,095,668 A 8/2000 Rykowski et al.
6,111,359 A 8/2000 Work et al.
6,161,910 A 12/2000 Reisenauer
6,186,646 B1 2/2001 Wiedemer
6,227,679 B1 5/2001 Zhang et al.
6,234,649 B1 5/2001 Katougi
6,294,973 B1 9/2001 Kimura
6,502,968 B1 1/2003 Simon
6,517,217 B1 2/2003 Liao
6,525,668 B1 2/2003 Petrick
6,598,996 B1 7/2003 Lodhie
6,641,283 B1 11/2003 Bohler
6,787,999 B2 9/2004 Stimac et al.
6,793,374 B2 9/2004 Begemann
D497,439 S 10/2004 Shaw et al.
6,814,470 B2 11/2004 Rizkin et al.
6,936,855 B1 8/2005 Harrah
6,948,829 B2 9/2005 Verdes et al.
6,982,518 B2 1/2006 Chou et al.
7,059,748 B2 6/2006 Coushaine
7,074,104 B2 7/2006 Itaya
7,111,961 B2 9/2006 Trenchard
7,125,146 B2 10/2006 Willis
7,144,140 B2 12/2006 Sun et al.
D534,665 S 1/2007 Egawa et al.
D535,038 S 1/2007 Egawa et al.
7,165,866 B2 1/2007 Li
7,198,387 B1 4/2007 Gloisten et al.
7,226,189 B2 6/2007 Lee et al.
7,281,818 B2 10/2007 You
7,300,173 B2 11/2007 Catalano
7,329,024 B2 2/2008 Lynch
7,331,689 B2 2/2008 Chen
7,347,589 B2 3/2008 Ge
7,431,477 B2 10/2008 Chou et al.
7,497,596 B2 3/2009 Ge
7,625,104 B2 12/2009 Zhang et al.
7,631,987 B2 12/2009 Wei
7,679,096 B1 3/2010 Ruffin
7,744,256 B2 6/2010 Smester
7,758,223 B2 7/2010 Osawa et al.
7,824,075 B2 11/2010 Maxik
7,918,587 B2 4/2011 Hsu et al.
7,919,339 B2 4/2011 Hsu
7,947,596 B2 5/2011 Takeda
7,963,686 B2 6/2011 Hu
8,058,782 B2 11/2011 Lai
8,058,784 B2 11/2011 Treurniet
8,066,417 B2 11/2011 Balazs
8,072,130 B2 12/2011 Wang et al.
8,157,418 B2 4/2012 Kraus
8,226,270 B2 7/2012 Yamamoto et al.
2002/0012246 A1 1/2002 Rincover et al.
2002/0024814 A1 2/2002 Matsuba
2002/0097586 A1 7/2002 Horowitz
2002/0118538 A1 8/2002 Calon et al.
2002/0145152 A1 10/2002 Shimomura
2002/0195918 A1 12/2002 Matsuba et al.
2003/0063476 A1 4/2003 English et al.
2003/0117797 A1 6/2003 Sommers et al.
2003/0117801 A1 6/2003 Lin
2003/0137838 A1 7/2003 Rizkin et al.
2003/0151917 A1 8/2003 Daughtry
2004/0012955 A1 1/2004 Hsieh
2004/0109310 A1 6/2004 Galli
2004/0120156 A1 6/2004 Ryan
2004/0145898 A1 7/2004 Ase et al.
2004/0156191 A1 8/2004 Biasoli
2004/0218385 A1 11/2004 Tomiyoshi
2004/0232815 A1* 11/2004 Tomiyoshi et al. ..... 313/318.1
2005/0007772 A1 1/2005 Yen
2005/0024864 A1 2/2005 Galli
2005/0068776 A1* 3/2005 Ge ..... 362/296
2005/0073244 A1 4/2005 Chou et al.
2005/0111234 A1 5/2005 Martin et al.
2005/0162864 A1 7/2005 Verdes et al.
2005/0174769 A1 8/2005 Yong
2005/0243552 A1 11/2005 Maxik
2005/0254246 A1 11/2005 Huang
2006/0034077 A1 2/2006 Chang
2006/0043546 A1 3/2006 Kraus
2006/0092640 A1 5/2006 Li
2006/0193130 A1 8/2006 Ishibashi
2006/0193139 A1 8/2006 Sun
2006/0198147 A1 9/2006 Ge
2006/0215408 A1 9/2006 Lee
2006/0219428 A1 10/2006 Chinda et al.
2006/0227558 A1 10/2006 Osawa
2006/0239002 A1 10/2006 Chou et al.
2007/0002570 A1 1/2007 Souza
2007/0041182 A1 2/2007 Ge et al.
2007/0096114 A1 5/2007 Aoki
2007/0103904 A1 5/2007 Chen
2007/0247840 A1 10/2007 Ham
2007/0279903 A1 12/2007 Negley
2007/0285926 A1* 12/2007 Maxik ..... 362/294
2008/0002100 A1 1/2008 Kaneko
2008/0006911 A1 1/2008 Nakahara et al.
2008/0037255 A1 2/2008 Wang
2008/0080187 A1 4/2008 Purinton
2008/0084701 A1 4/2008 Van De Ven
2008/0112170 A1 5/2008 Trott
2008/0130298 A1 6/2008 Negley
2008/0173883 A1 7/2008 Hussell
2008/0289867 A1 11/2008 Owens
2009/0059595 A1 3/2009 Ge
2009/0116229 A1 5/2009 Dalton
2009/0116231 A1 5/2009 Miller
2009/0175041 A1 7/2009 Yuen et al.
2009/0184616 A1 7/2009 Van de Ven
2009/0184646 A1 7/2009 Devaney
2009/0207602 A1 8/2009 Reed
2009/0294780 A1 12/2009 Chou
2009/0315442 A1 12/2009 Rooymans
2010/0026157 A1 2/2010 Tanaka
2010/0060130 A1 3/2010 Li
2010/0067241 A1 3/2010 Lapatovich
2010/0096992 A1 4/2010 Yamamoto
2010/0207534 A1 8/2010 Dowling
2010/0219735 A1 9/2010 Sakai et al.
2010/0225220 A1 9/2010 Tanaka et al.
2010/0237761 A1 9/2010 Osawa et al.
2010/0237779 A1 9/2010 Osawa et al.
2010/0244650 A1 9/2010 Osawa et al.
2010/0244694 A1 9/2010 Osawa et al.
2010/0253200 A1 10/2010 Osawa et al.
2010/0277082 A1 11/2010 Reed
2010/0289393 A1 11/2010 Cantrell et al.
2010/0289396 A1* 11/2010 Osawa et al. ..... 313/46
2010/0315442 A1 12/2010 Rooymans
2010/0327746 A1 12/2010 Hisayasu
2010/0327751 A1 12/2010 Takenaka et al.
2011/0025206 A1 2/2011 Hiramatsu et al.
2011/0043120 A1 2/2011 Panagotacos et al.
2011/0050133 A1 3/2011 Grajcar et al.
2011/0063842 A1 3/2011 Takei et al.
2011/0068674 A1 3/2011 Takenaka et al.
2011/0074269 A1 3/2011 Hisayasu et al.

(56) References Cited

U.S. PATENT DOCUMENTS

| | | | |
|---|---|---|---|
| 2011/0074271 | A1 | 3/2011 | Takeshi et al. |
| 2011/0074290 | A1 | 3/2011 | Sakai et al. |
| 2011/0074291 | A1 | 3/2011 | Osawa et al. |
| 2011/0079814 | A1 | 4/2011 | Chen |
| 2011/0089806 | A1 | 4/2011 | Suwa et al. |
| 2011/0090691 | A1 | 4/2011 | Markle et al. |
| 2011/0139491 | A1 | 6/2011 | Chang |
| 2011/0156569 | A1 | 6/2011 | Osawa |

FOREIGN PATENT DOCUMENTS

| | | |
|---|---|---|
| CN | 1433070 | 7/2003 |
| CN | 1644978 | 7/2005 |
| CN | 1880844 | 12/2006 |
| CN | 201014266 | 1/2008 |
| CN | 201081193 | 7/2008 |
| CN | 101307887 | 11/2008 |
| CN | 201180976 | 1/2009 |
| CN | 101506934 | 8/2009 |
| CN | 101521140 | 9/2009 |
| DE | 10 2004 042186 | 3/2006 |
| DE | 20 2008 016 2 | 4/2009 |
| DE | 20 2008 016 868 | 4/2009 |
| EP | 1 215 735 | 6/2002 |
| EP | 1705421 | 9/2006 |
| EP | 2037633 | 3/2009 |
| EP | 2149742 | 2/2010 |
| EP | 2 163 808 | 3/2010 |
| JP | 57-152706 | 9/1982 |
| JP | 59-035303 | 2/1984 |
| JP | 61-35216 | 2/1986 |
| JP | 62-190366 | 12/1987 |
| JP | 63-5581 | 1/1988 |
| JP | 63-102265 | 5/1988 |
| JP | 64-7204 | 1/1989 |
| JP | 1-206505 | 8/1989 |
| JP | 2-91105 | 3/1990 |
| JP | 2000-083343 | 3/2000 |
| JP | 2000-173303 | 6/2000 |
| JP | 2001-243809 | 9/2001 |
| JP | 2002-043771 | 2/2002 |
| JP | 2002-525814 | 8/2002 |
| JP | 2002-280617 | 9/2002 |
| JP | 2003-016808 | 1/2003 |
| JP | 2003-059305 | 2/2003 |
| JP | 2003-59330 | 2/2003 |
| JP | 2003-92022 | 3/2003 |
| JP | 2004-6096 | 1/2004 |
| JP | 2004-119078 | 4/2004 |
| JP | 2004-193053 | 7/2004 |
| JP | 2004-6096 | 8/2004 |
| JP | 2004-221042 | 8/2004 |
| JP | 2005-085484 | 3/2005 |
| JP | 2005-93097 | 4/2005 |
| JP | 2005-123200 | 5/2005 |
| JP | 2005-513815 | 5/2005 |
| JP | 2005-166578 | 6/2005 |
| JP | 2005-217354 | 8/2005 |
| JP | 2005-286267 | 10/2005 |
| JP | 2006-040727 | 2/2006 |
| JP | 3121916 | 5/2006 |
| JP | 2006-156187 | 6/2006 |
| JP | 2006-244725 | 9/2006 |
| JP | 2006-28646 | 10/2006 |
| JP | 2006-310057 | 11/2006 |
| JP | 2006-313717 | 11/2006 |
| JP | 2006-313718 | 11/2006 |
| JP | 2007-073306 | 3/2007 |
| JP | 2007-188832 | 7/2007 |
| JP | 2007-207576 | 8/2007 |
| JP | 2008-027910 | 2/2008 |
| JP | 2008-91140 | 4/2008 |
| JP | 2008-227412 | 9/2008 |
| JP | 2008-277561 | 11/2008 |
| JP | 2008-282829 | 11/2008 |
| JP | 2009-37995 | 2/2009 |
| JP | 2009-037995 | 2/2009 |
| JP | 2009-117342 | 5/2009 |
| JP | 2009-135026 | 6/2009 |
| JP | 2009-164157 | 7/2009 |
| JP | 2009-206104 | 8/2009 |
| WO | WO 03/056636 | 7/2003 |
| WO | WO 2005/024898 | 3/2005 |
| WO | WO 2006/118457 | 11/2006 |
| WO | WO 2008/146694 | 12/2008 |
| WO | WO2009/085231 | 7/2009 |
| WO | WO 2009/087897 | 7/2009 |
| WO | WO 2009087897 A1 * | 7/2009 |

OTHER PUBLICATIONS

English language abstract of JP-2005-286267 published Oct. 13, 2005.
English language abstract of JP-2002-280617 published Sep. 27, 2002.
English language abstract of JP-2003-016808 published Jan. 17, 2003.
English language abstract of JP-2006-244725 published Sep. 14, 2006.
Machine English language translation of JP-2005-286267 published Oct. 13, 2005.
Machine English language translation of JP-2002-280617 published Sep. 27, 2002.
Machine English language translation of JP-2003-016808 published Jan. 17, 2003.
Machine English language translation of JP-2006-244725 published Sep. 14, 2006.
English Language Abstract of JP 2008-91140 published Apr. 17, 2008.
Machine English language translation of JP 2008-91140 published Apr. 17, 2008.
English Language Abstract of 2003-59330 published Feb. 28, 2003.
Machine English language translation of JP 2003-59330 published Feb. 28, 2003.
Extended European Search Report issued in EP 111560003.9 on May 18, 2011.
Extended European Search Report issued in EP 08838942.4 on Jun. 1, 2011.
English Language Abstract of JP 2008-277561 published on Nov. 13, 2008.
English Language Translation of JP 2008-277561 published on Nov. 13, 2008.
English Language Abstract of JP 2008-227412 published Sep. 25, 2008.
English Language Translation of JP 2008-227412 published Sep. 25, 2008.
Japanese Office Action issued in 2005-269017 on Jan. 13, 2011.
English Language Translation of Japanese Office Action issued in 2005-269017 on Jan. 13, 2011.
English Language Abstract of JP 2004-221042 published Aug. 5, 2004.
English Language Translation of JP 2004-221042 published Aug. 5, 2004.
English Language Abstract of JP 63-102265 published May 7, 1988.
English Language Abstract of JP 2009-206104 published Sep. 10, 2009.
English Language Translation of JP 2009-206104 published Sep. 10, 2009.
European Search Report issued in EP 10178361.1 on Jul. 4, 2011.
U.S. Appl. No. 13/034,959, filed Feb. 25, 2011, Pending.
U.S. Appl. No. 13/172,557, filed Jun. 29, 2011, Pending.
U.S. Appl. No. 13/221,519, filed Aug. 30, 2011, Pending.
U.S. Appl. No. 13/221,551, filed Aug. 30, 2011, Pending.
English Language Abstract of JP 2001-243809, published Sep. 7, 2001.
English Language Abstract of JP Publication 01-206505 published Aug. 18, 1989.

(56) References Cited

OTHER PUBLICATIONS

English Language Abstract of JP Publication 2005-093097 published Apr. 7, 2005.
English Language Abstract of JP Publication 2005-123200 published May 12, 2005.
English Language Abstract of JP 2006-313718, published Nov. 16, 2006.
English Language Abstract of JP Publication 63-005581 published Jan. 11, 1988.
English Language Abstract of JP Publication 64-007402 published Jan. 11, 1989.
English Language Machine Translation of JP 2000-083343, published Mar. 21, 2000.
English Language Machine Translation of JP 2000-173303 published Jun. 23, 2000.
English Language Machine Translation of JP 2001-243809, published Sep. 7, 2001.
English Language Machine Translation of JP 2004-006096 published Jan. 8, 2004.
English Language Machine Translation of JP 2004-193053 published Jul. 8, 2004.
English Language Machine Translation of JP 2005-166578 published Jun. 23, 2005.
English Language Machine translation of JP 2005-513815 published May 12, 2005.
English Language Machine translation of JP 2006-040727 published Feb. 9, 2006.
English Language Machine Translation of JP 2006-310057, published Nov. 9, 2006.
English Language Machine Translation of JP 2006-313718, published Nov. 16, 2006.
English Language Machine Translation of JP 2009-37995, published Feb. 19, 2009.
English Language Machine Translation of JP 3121916, published May 10, 2006.
English Language Machine Translation of JP Publication 2005-093097 published Apr. 7, 2005.
English Language Machine Translation of JP Publication 2005-123200.
English Language Machine Translation of JP 2003-092022 published Mar. 28, 2003.
English Language Translation of Office Action issued in corresponding Japanese Appl 2005-221571 on Oct. 20, 2009.
English Language Translation of International Search Report for PCT/JP2008/073436 mailed Mar. 24, 2009.
English translation of Office Action issued in corresponding Japanese Appl 2005-221571 on Jul. 7, 2009.
English translation of Office Action issued in corresponding Japanese Appl 2005-221571 on Aug. 25, 2009.
English Language Translation of Office Action issued in Japanese Appl 2005-221688 on Jan. 26, 2010.
Office Action issued in corresponding Japanese Appl 2005-221571 on Jul. 7, 2009.
Office Action issued in corresponding Japanese Appl 2005-221571 on Aug. 25, 2009.
Office Action issued in corresponding Japanese Appl 2005-221571 on Oct. 20, 2009.
English Language Abstract of JP 2-91105 published Mar. 30, 1990.
English Language Abstract of JP 2000-173303 published Jun. 23, 2000.
English Language Abstract of JP 2003-092022 published Mar. 28, 2003.
English Language Abstract of JP 2005-166578 published Jun. 23, 2005.
English Language Abstract of JP 2006-040727 published Feb. 9, 2006.
English Language Abstract of JP 2004-006096 published Jan. 8, 2004.
Office Action issued in Japanese Appl 2005-221688 on Jan. 26, 2010.
English Language Abstract of JP 2009-37995, published Feb. 19, 2009.
English Language Abstract of JP 2000-083343, published Mar. 21, 2000.
English Language Abstract of JP 57-152706 published Sep. 21, 1982.
English Language Abstract of JP 2006-310057, published Nov. 9, 2006.
International Preliminary Report on Patentability and Written Opinion issued in PCT/JP2008/068625 mailed May 11, 2010.
Office Action issued in Japanese Appl 2005-371406 on Apr. 20, 2010.
English Translation of Office Action issued in Japanese Appl 2005-371406 on Apr. 20, 2010.
U.S. Appl. No. 12/794,558.
U.S. Appl. No. 12/713,230.
Japanese Office Action issued in JP 2008-198625 on May 26, 2010.
English Translation of Japanese Office Action issued in JP 2008-198625 on May 26, 2010.
Amendment filed in JP 2008-198625 on Jun. 28, 2010.
English Translation of Amendment filed in JP 2008-198625 on Jun. 28, 2010.
English Language Abstract of JP 2006-313717 published Nov. 16, 2006.
Machine English Translation of JP 2006-313717 published Nov. 16, 2006.
English Language Abstract of JP 2009-135026 published Jun. 18, 2009.
English Language Translation of JP 2009-135026 published Jun. 18, 2009.
English Language Abstract of JP 2002-525814 published Aug. 13, 2002.
English Language Abstract of JP 2003-059305 published Feb. 28, 2003.
English Language Translation of JP 2003-059305 published Feb. 28, 2003.
English Language Abstract of JP 2009-037995 published Feb. 19, 2009.
English Language Translation of JP 2009-037995 published Feb. 19, 2009.
English Language Abstract of JP 2007-188832 published Jul. 26, 2007.
English Language Translation of JP 2007-188832 published Jul. 26, 2007.
English Language Abstract of JP 2008-027910 published Feb. 7, 2008.
English Language Translation of JP 2008-027910 published Feb. 7, 2010.
English Language Abstract of JP 2007-207576 published Aug. 16, 2007.
English Language Translation of JP 2007-207576 published Aug. 16, 2007.
English Language Abstract of JP 2007-073306 published Mar. 22, 2007.
English Language Translation of JP 2007-073306 published Mar. 22, 2007.
Extended European Search Report issued in EP Appl 10006720.6 on Oct. 13, 2010.
English Language Abstract of JP 61-35216 published Feb. 2, 1086.
IPRP & WO issued in PCT/JP2008/073436 on Aug. 10, 2010.
English Language Abstract of JP 2004-193053 published Jul. 8, 2004.
English Language Translation of JP 2002-525814 published Aug. 13, 2002.
English Language Abstract of JP 2006-156187 published Jun. 15, 2006.
English Language Translation of JP 2006-156187 published Jun. 15, 2006.
Chinese Office Action issued in CN 201010216943 on Oct. 26, 2011.
English Language Translation of Chinese Office Action issued in CN 201010216943 on Oct. 26, 2011.
English Language Abstract of CN 101307887 published Nov. 19, 2008.
English Language Translation of JP 2009/117342 published May 28, 2009.

(56) References Cited

OTHER PUBLICATIONS

English Language Abstract of JP 2009/117342 published May 28, 2009.
English Language Abstract of JP 2004-119078 published Apr. 15, 2004.
English Language Translation of JP 2004-119078 published Apr. 15, 2004.
Chinese Office Action issued in CN 201010121809.11 on Mar. 31, 2012.
English Translation of Chinese Office Action issued in CN 201010121809.11 on Mar. 31, 2012.
English Language Abstract and Claims of CN201149860 published Nov. 12, 2008.
English Language Abstract and Claims of CN201072113 published Jun. 11, 2008.
English Language Abstract of CN2602514 published Feb. 4, 2004.
U.S. Appl. No. 13/172,557.
Extended European Search Report for EP 10179580.5, dated May 24, 2012.
Chinese Office Action issued in CN 201010243165.3 on Jul. 17, 2012.
English Language Translation of Chinese Office Action issued in CN 201010243165.3 on Jul. 17, 2012.
English Language Abstract of CN 1264152 published Aug. 23, 2000.
U.S. Appl. No. 12/825,650.
U.S. Appl. No. 12/811,795.
U.S. Appl. No. 12/738,081.
U.S. Appl. No. 12/880,490.
U.S. Appl. No. 12/845,330.
U.S. Appl. No. 12/885,005.
U.S. Appl. No. 12/886,025.
U.S. Appl. No. 12/886,123.
U.S. Appl. No. 13/044,369.
U.S. Appl. No. 12/888,921.
Chinese Office Action issued in CN 201010216943 on Jul. 11, 2012.
English Language Translation of Chinese Office Action issued in CN 201010216943 on Jul. 11, 2012.
Chinese Office Action issued in CN2010102793033 on Jul. 10, 2012.
English Language Translation of Chinese Office Action issued in CN2010102793033 on Jul. 10, 2012.
English Language Abstract JP 2005-217354 published Aug. 11, 2005.
English Language Translation of JP 2005-217354 published Aug. 11, 2005.
English Language Abstract of JP 2006-286461 published Oct. 19, 2006.
English Language Translation of JP 2006-286461 published Oct. 19, 2006.
English Language Abstract of WO 2009/085231 published Jul. 9, 2009.
English Language Abstract of CN 1644978 published Jul. 27, 2005.
Chinese Office Action issued in CN 201010292756 dated Jun. 29, 2012.
English Language Translation of Chinese Office Action issued in CN 201010292756 dated Jun. 29, 2012.
English Language Abstract of CN 201014266 published Jan. 30, 2008.
Chinese Office Action issued in CN 2010102927860.6 dated Sep. 29, 2012.
English Language Translation of Chinese Office Action issued in CN 2010102927860.6 dated Sep. 29, 2012.
English Language Abstract of CN 201081193 published Jul. 2, 2008.
English Language Abstract of CN 1380704 published Nov. 20, 2002.
English Language Abstract of CN 101521140 published Sep. 2, 2009.
English Language Abstract of CN 101506934 published Aug. 12, 2009.
English Language Abstract of CN 201180976 published Jan. 14, 2009.
English Language Abstract of CN 1880844 published Dec. 20, 2006.
Chinese Office Action issued in CN 201010292771.4 dated Jun. 19, 20123.
English Language Translation of Chinese Office Action issued in CN 201010292771.4 dated Jun. 19, 20123.
Japanese Office Action issued in JP2009-219771 on Aug. 9, 2012.
English Language Translation of Japanese Office Action issued in JP2009-219771 on Aug. 9, 2012.
English Language Abstract of JP 2009-164157 published Jul. 23, 2009.
English Language Tranlsation of JP 2009-164157 published Jul. 23, 2009.
Chinese Office Action issued in CN201010287917.6 dated Jun. 27, 2012.
English Language Translation of Chinese Office Action issued in CN201010287917.6 dated Jun. 27, 2012.
English Language Abstract of CN 1433070 published Jul. 30, 2003.
U.S. Appl. No. 12/933,969.
U.S. Appl. No. 12/794,379.
U.S. Appl. No. 12/794,429.
U.S. Appl. No. 12/794,476.
U.S. Appl. No. 12/794,509.
U.S. Appl. No. 12/825,956.
U.S. Appl. No. 12/885,849.
U.S. Appl. No. 13/034,959.
U.S. Appl. No. 13/221,519.
U.S. Appl. No. 13/221,551.
Japanese Office Action issued in JP 2009-156100 on Apr. 16, 2013.
English Language Translation of Japanese Office Action issued in JP 2009-156100 on Apr. 16, 2013.
English Language Abstract of JP 2002-043771 published Feb. 8, 2002.
English Language Translation of JP 2002-043771 published Feb. 8, 2002.
English Language Abstract of JP 2008-282829 published Nov. 20, 2008.
English Language Translation of JP 2008-282829 published Nov. 20, 2008.
English Language Abstract of JP 2005-085484 published Mar. 31, 2005.
English Language Translation of JP 2005-085484 published Mar. 31, 2005.
U.S. Appl. 12/811,795.
Partial Related U.S. Appl. No. 12/794,379 electronically captured on Mar. 11, 2014 between Dec. 11, 2013 and Mar. 11, 2014.
Partial Related U.S. Appl. No. 12/794,429 electronically captured on Mar. 11, 2014 between Dec. 11, 2013 and Mar. 11, 2014.
Partial Related U.S. Appl. No. 12/794,476 electronically captured on Mar. 11, 2014 between Dec. 11, 2013 and Mar. 11, 2014.
Partial Related U.S. Appl. No. 12/794,509 electronically captured on Mar. 11, 2014 between Dec. 11, 2013 and Mar. 11, 2014.
Partial Related U.S. Appl. No. 12/885,849 electronically captured on Mar. 11, 2014 between Dec. 11, 2013 and Mar. 11, 2014.
Partial Related U.S. Appl. No. 13/221,551 electronically captured on Mar. 11, 2014 between Dec. 11, 2013 and Mar. 11, 2014.

* cited by examiner

LIGHTING DEVICE HAVING A THROUGH-HOLE AND A GROOVE PORTION FORMED IN THE THERMALLY CONDUCTIVE MAIN BODY

CROSS-REFERENCE TO RELATED APPLICATION

This application is based upon and claims the benefit of priority from prior Japanese Patent Application No. 2009-46121, filed on Feb. 27, 2009 and prior Japanese Patent Application No. 2009-156100, filed on Jun. 30, 2009, the entire contents of which are incorporated herein by reference.

TECHNICAL FIELD

The invention relates to a lighting device and a lighting fixture having a semiconductor light-emitting device such as a light-emitting diode as a light source.

BACKGROUND

In recent years, a lighting device such as a bulb-type LED lamp having a light source of light-emitting diode has been used for various lighting fixtures as an alternative light source to a filament light bulb. The light-emitting diode is a semiconductor light-emitting element which has long life and low power consumption. When such type of lighting device with a light source of light-emitting diode is manufactured, the lighting device needs to be designed to be small in size and lead to improved productivity for mass production by taking the advantages of the light-emitting diode, and to produce a luminous flux comparable to that of a filament light bulb.

JP-A 2008-91140 (KOKAI) describes an LED light bulb and a lighting fixture, which include light-emitting diodes mounted on a substrate, a power supply device to turn on the light-emitting diodes, a cover to house the power supply device, the cover having a base mounted on one side and the substrate attached on the other side, and a translucent globe provided to cover the light-emitting diodes.

Also, JP-A 2003-59330 (KOKAI) describes an LED lighting fixture using a plate-shaped LED module mounted with multiple light-emitting diodes. The LED module is provided with a terminal block to directly connect an electric supply wire to the LED module, and thereby can be easily connected to the electric supply wire.

In the LED lighting fixture described in JP-A 2003-59330 (KOKAI), however, the electric supply wire to the light-emitting diodes are routed through the outside of a substrate from the back side of the substrate to the terminal block provided on the front surface of the substrate. The electric supply wire thus projects outward from the peripheral edge of the substrate. In order to mount the LED module on a lighting fixture body, the outer diameter dimensions of the fixture body must be inevitably large enough to provide an electrical insulation distance between the fixture body and the electric supply wire. The fixture body cannot be designed to be small in size.

JP-A 2003-59330 (KOKAI) also states that the electric supply wire may be designed to be connected to the terminal block from the back side of the substrate. However, if the lighting fixture is designed in such a manner, the wire will be interposed between the back side of the substrate and the fixture body which supports the substrate.

For this reason, if the LED light bulb described in JP-A 2008-91140 (KOKAI) is to be configured by using the light-emitting module described in JP-A 2003-59330 (KOKAI), the substrate cannot be in close contact with a base when being supported by the base because the electric supply wire resides between the back side of the substrate and the fixture body.

Consequently, heat of the light-emitting diodes mounted on the substrate cannot be effectively conducted to the fixture body which is composed of a metal having a high thermal conductivity, such as aluminum. This reduces light-emitting efficiency of the light-emitting diodes and thereby makes it difficult to achieve predetermined luminous flux.

Furthermore, when the electric supply wires are connected to the back side of the substrate, the connection must be made beforehand because the connection cannot be made once the substrate is fixed to the fixture body.

In this case, the substrate suspended in the air due to being connected with the electric supply wire is to be installed to the fixture body. When the substrate is fixed to the fixture body, the electric supply wire may break due to an external force applied to the connection portion, or the electric supply wire may come off from a quick connect terminal of the terminal block. Thus, such a lighting fixture is unsuitable for mass production.

SUMMARY

An object of the invention is to solve the above mentioned problems and provide a lighting device and a lighting fixture which is reduced in size and at the same time is configured to be suitable for mass production and is capable of producing a certain luminous flux.

A lighting device according to an embodiment of the present invention comprises a thermally conductive main body having a substrate support portion in one end portion, and having a through-hole and a groove portion formed in the substrate support portion, the through-hole penetrating from the one end portion to the other end portion of the main body, the groove portion extending continuously from the through-hole, a substrate mounted with a semiconductor light-emitting device, and disposed on the substrate support portion of the main body, an electrical connector disposed on the substrate and connected to the semiconductor light-emitting device, a power supply device housed in the main body and configured to light the semiconductor light-emitting device, a wire having one end connected to the power supply device and the other end connected to the electrical connector while being inserted through the through-hole and the groove portion of the main body, and a base member provided in the other end portion of the main body and connected to the power supply device.

According to a second aspect of the present invention, a notch-shaped wire insertion portion is formed in a peripheral edge of the substrate, and the substrate is disposed on the substrate support portion of the main body in such a manner that the wire insertion portion faces the groove portion.

According to a third aspect of the present invention, the substrate support portion is formed as a stepped portion projecting to the one end portion side.

According to a fourth aspect of the present invention, the substrate is provided with a protecting member at least in a peripheral edge portion facing the wire, the protecting member having an electrical insulation property.

A lighting fixture according to an another embodiment of the present invention comprises a fixture body provided with a socket and the lighting device attached to the socket of the fixture body.

According to a fifth aspect of the present invention, the lighting device is any one of: a bulb-type lighting device (A or PS type) which is similar to the shape of a common filament light bulb; a spherical bulb-type lighting device (G type); a cylindrical bulb-type lighting device (T type); a reflector-shaped bulb-type lighting device (R type); and a globeless bulb-type lighting device.

According to a sixth aspect of the present invention, the semiconductor light-emitting device is any one of a light-emitting diode and a semiconductor laser.

According to a seventh aspect of the present invention, the semiconductor light-emitting device includes any one of a single device, a plurality of devices, a group of devices, and a plurality of groups of devices.

According to an eighth aspect of the present invention, a part of or all of the semiconductor light-emitting devices are mounted in a certain regular pattern such as any one of a matrix, staggered, radial arrangement pattern by using any one of surface mount device type and chip on board technology.

According to a ninth aspect of the present invention, the semiconductor light-emitting device include any one of a white, red, blue and green device, and any combination of the white, red, blue and green devices according to an application of the lighting fixture.

According to a tenth aspect of the present invention, the main body is composed of a highly thermally conductive metallic material.

According to an eleventh aspect of the present invention, the main body is composed of a material including at least one of: aluminum (Al), copper (Cu), iron (Fe), nickel (Ni), aluminum nitride (AlN), silicon carbide (SiC), and a synthetic resin.

According to a twelfth aspect of the present invention, the substrate support portion in the one end portion of the main body includes a flat surface on which the substrate mounted with the semiconductor light-emitting device is supported in close contact with the substrate support portion.

According to a thirteenth aspect of the present invention, the through-hole penetrating from the one end portion to the other end portion side in the substrate support portion is formed at an approximately central portion of the substrate support portion.

According to a fourteenth aspect of the present invention, the lighting fixture is any one of: a ceiling flush type, a direct mounting type, a pendant type, and a wall mounting type.

According to a fifteenth aspect of the present invention, the through-hole penetrating from the one end portion to the other end portion side in the substrate support portion is formed at a position displaced from a central portion of the substrate support portion outward in a radial direction.

According to a sixteenth aspect of the present invention, the groove portion extending continuously from the through-hole is formed as an approximately linear groove extending from the through-hole outward in a radial direction of the substrate support portion.

According to a seventeenth aspect of the present invention, the groove portion extending continuously from the through-hole is formed as a curved groove extending in a rotational direction about the through-hole.

According to an eighteenth aspect of the present invention, the substrate is composed of a material including at least one of: aluminum, copper, stainless steel, synthetic resin, glass epoxy material, and paper phenol material.

According to a nineteenth aspect of the present invention, the substrate is formed in any one of a polygonal shape and an elliptical shape.

According to a twentieth aspect of the present invention, the electrical connector is connected to a wiring pattern formed on the substrate by using any one of connector means, soldering, and screwing.

According to a twenty-first aspect of the present invention, the electrical connector directly connects the semiconductor light-emitting device to the wire.

According to a twenty-second aspect of the present invention, the power supply device includes a light control circuit to control light of the semiconductor light-emitting device.

According to a twenty-third aspect of the present invention, the base member is an Edison type E17 or E26 base.

According to a twenty-fourth aspect of the present invention, a notch formed at a peripheral edge of the substrate has a larger width dimension than that of the groove portion.

According to a twenty-fifth aspect of the present invention, the electrical connector is disposed to face a wire insertion portion of the substrate.

According to a twenty-sixth aspect of the present invention, the wire is a wire having a shape and dimensions that allow the wire to be inserted through the through-hole of the main body and into a wire insertion portion of the substrate, and to be housed in the groove portion.

According to a twenty-seventh aspect of the present invention, the substrate support portion has a height at least sufficient to form a groove allowing an insertion of the wire, and a surface of the substrate support portion surrounded by a stepped portion has the same or larger surface area than that of the substrate on which the semiconductor light-emitting device is mounted.

According to a twenty-eighth aspect of the present invention, a portion facing an opening of the groove portion is provided with a protecting member.

According to a twenty-ninth aspect of the present invention, the protecting member is composed of a material including at least one of: silicone resin, synthetic resin, and synthetic rubber.

DESCRIPTION OF DRAWINGS

The accompanying drawings, which are incorporated in and constitute a part of this specification, illustrate embodiments of the invention and together with the description, serve to explain the principles of the invention.

DETAILED DESCRIPTION

First Embodiment

Figure 1:
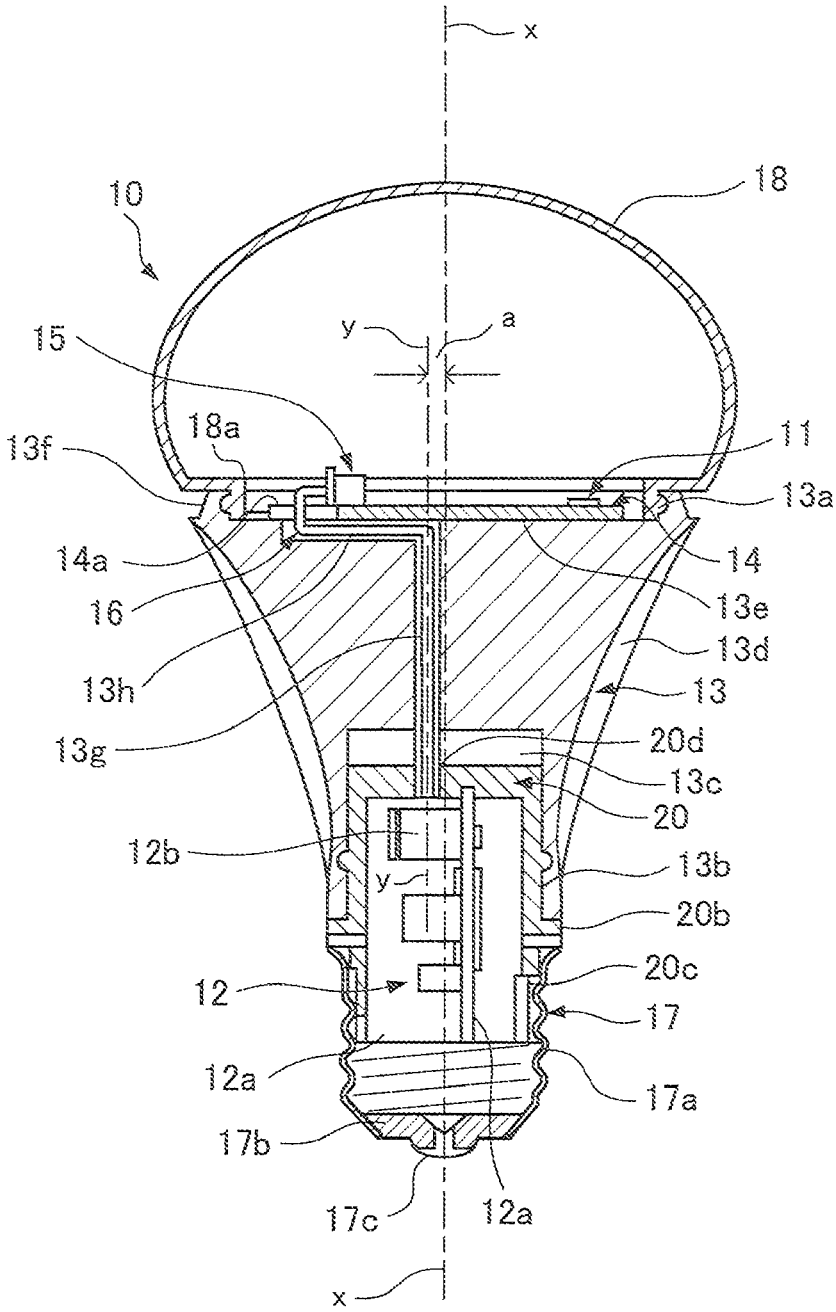
FIG. 1 shows a longitudinal cross-sectional view of a lighting device according to a first embodiment of the invention.

Hereinafter, embodiments of a lighting device and a lighting fixture according to the invention will be described.

A lighting device according to the embodiment is configured as a lighting device 10 having a small-bulb shape similar to a mini krypton bulb. A lighting device according to the embodiment includes a semiconductor light-emitting device 11, a power supply device 12 to light the semiconductor light-emitting device, a main body 13 having substrate support portion 13*e* in one end portion and power supply device 12 in the other end portion side, a substrate 14 on which the semiconductor light-emitting device is disposed, an electrical connector 15 connected to the semiconductor light-emitting device 11, an wire 16 having one end connected to the power supply device and the other end connected to the electrical connector, a base member 17 provided at the other end portion side of the main body and connected to the power supply device 12, and a cover member 18.

In the embodiment, the semiconductor light-emitting device 11 is configured as a light-emitting diode (hereinafter referred to as "LED"). Multiple LEDs which have the same performance are provided in the embodiment. In the embodiment, four of the LEDs 11 are provided. The LED of the embodiment includes a blue LED chip and a high-intensity, high-output LED of SMD type which emits white light by exciting yellow phosphor with the blue LED chip. In general, the light is directionally emitted mainly in one direction that is the direction of the optical axis of the LEDs. The optical axis is approximately vertical to the surface of the substrate 14 on which the LEDs 11 are mounted.

The power supply device 12 to light the LEDs 11 has circuit components constituting a lighting circuit of the four LEDs mounted on a plate-shaped circuit board 12*a*. The lighting circuit converts AC 100V to DC 24V and supplies the DC 24V to each LED 11. The circuit board 12*a* has a long rectangular strip shape extending in the longitudinal direction. A circuit pattern is formed on one side or both sides of the circuit board 12*a* on which multiple small electronic components 12*b* constituting the lighting circuit are mounted, the electronic components 12*b* including lead components such as small electrolytic capacitors and chips such as transistors. The circuit board 12*a* is housed in an insulating case 20 in the other end portion side of the main body 13 in a longitudinal direction. The wire 16 to supply power to the semiconductor light-emitting device 11 is connected to the output terminal of the circuit board. An input line (not shown) is connected to the input terminal of the circuit board.

The main body 13 is composed of a highly thermally conductive metal. In the embodiment, the main body 13 is composed of aluminum. The center portion of the main body 13 has an approximately circular cross-sectional shape, and is formed into a cylindrical shape. The main body 13 has an opening portion 13*a* with a larger diameter in the one portion, and an opening portion 13*b* with a smaller diameter in the other end portion. A housing recess portion 13*c* is formed in the opening portion 13*b*. Peripheral surface of the main body 13 is formed into a conical tapered surface in such a manner that the cross-sectional diameter gradually decreases from the one end portion to the other end portion. The external appearance of the main body 13 is similar to a shape of a neck portion of a mini krypton bulb. A large number of heat dissipation fins 13*d* are formed integrally with the main body 13 on the peripheral surface, the heat dissipation fins 13*d* projecting radially and extending from the one end portion to the other end portion. The center portion of the main body 13 is processed by casting, forging, machining, or the like for example, and is formed into a cylinder with a thick wall and a small hollow space inside the cylinder.

A substrate support portion 13*e* is formed integrally with the main body 3 in the opening portion 13*a* in the one end portion of the main body 13, the substrate support portion 13*e* having a flat surface so that a circular recess portion is formed in the opening portion 13*a*. A ring-shaped projecting strip portion 13*f* is formed integrally with the main body 13 around the recess portion. Also, a through-hole 13*g* linearly penetrating the main body 13 along the central axis x-x of the main body is formed from the center portion of the substrate support portion 13*e* to the opening portion 13*b* in the other end portion. The wire 16 to supply power is inserted into the through-hole 13*g*. The through-hole 13*g* is formed so that the central axis y-y of the through-hole is formed at a position displaced outward from the central axis x-x of main body 13 by a distance of "a" in radial direction. A groove portion 13*h* is formed integrally with the main body 13 in the substrate support portion 13*e*. The groove portion 13*h* is continuously connected to the through-hole 13*g*, and extends approximately linearly along the radial direction in which the through-hole is displaced outward from the central axis x-x by the distance of "a." The width and depth of the groove portion 13*h* are determined so that the wire 16 to supply power can be fitted into and housed in the groove portion 13*h* thereby not projecting from the surface of the substrate support portion 13*e*.

The housing recess portion 13*c* formed integrally with the main body 13 in the other end portion of the main body 13 is a recess portion to dispose the circuit board 12*a* on which the power supply device 12 is mounted in the inside of the recess portion. A horizontal cross-section of the housing recess portion 13*c* is approximately a circle with the center at the central axis x-x of the main body 13. The through-hole 13*g* mentioned above penetrates the bottom surface of the housing recess portion 13*c*. An insulating case 20 is fitted into the housing recess portion 13*c* in order to provide insulation between the power supply device 12 and the main body 13 composed of aluminum. The insulating case is composed of synthetic resin having an electrical insulation property and heat resistance, such as Poly Butylene Terephthalate (PBT). An opening portion 20*a* is formed at one end of the housing recess portion 13*c*, and the other end of housing recess portion 13*c* is closed and thereby formed into a cylindrical shape with closed bottom which approximately matches with the inner surface shape of the insulating case 20. The circuit board 12*a* is fixed to the inside of the housing recess portion 13*c* with a screw or adhesives such as silicone resin and epoxy resin. The insulating case 20 has a locking portion 20*b*, which is a ring-shaped flange, formed at approximately middle portion of the peripheral surface of the insulating case 20. A peripheral surface of a portion projecting to the one end portion from the locking portion 20*b* is formed into a stepped pattern, and is formed integrally with a base fixing portion 20*c*. An insertion hole 20*d* is formed so that the wire 16 can be inserted through the insertion hole 20*d*. The insertion hole 20*d* penetrates the closed bottom surface of the insulating case and is aligned with the through-hole 13*g* of the main body 13.

Figure 2:
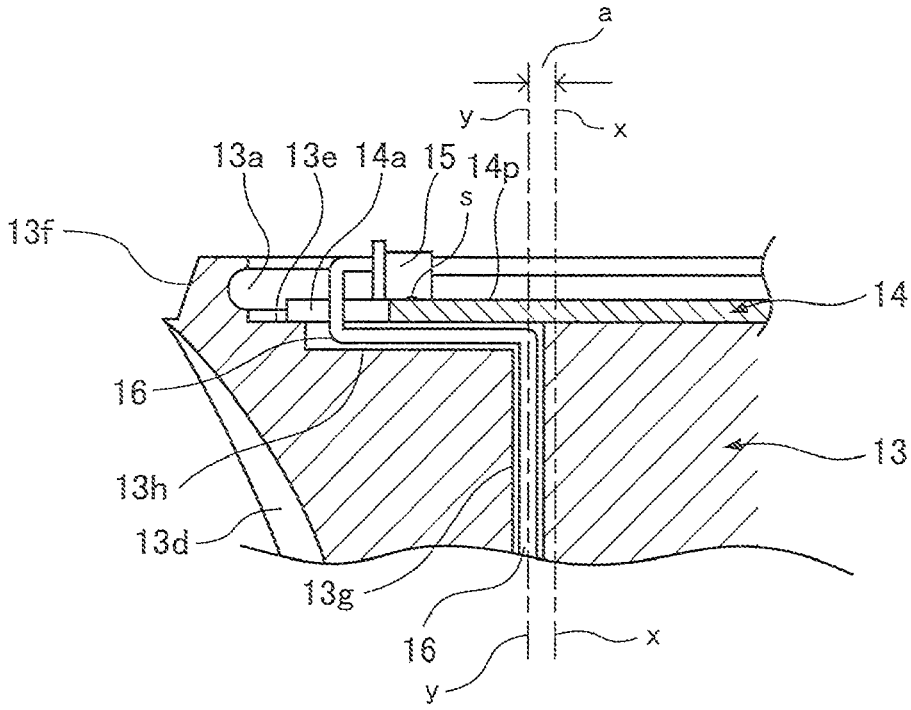
FIG. 2 shows an enlarged cross-sectional view of a substrate support portion of the lighting device.
Figure 3A:
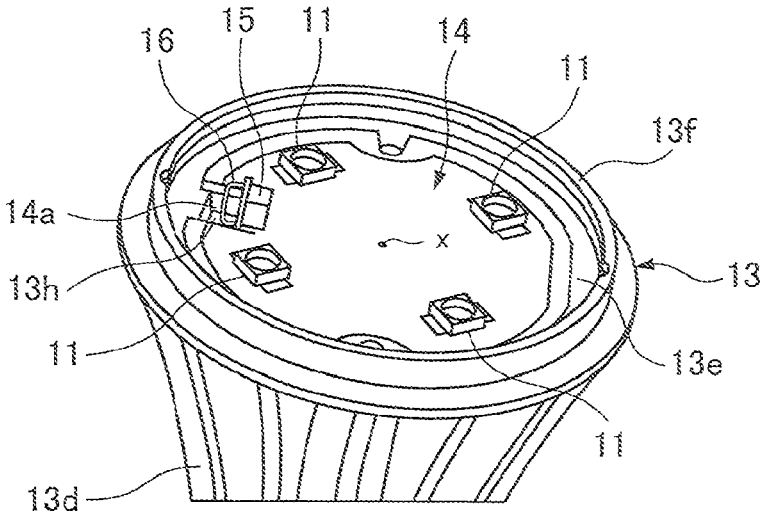
FIG. 3A shows a perspective view of a substrate support portion of the lighting device in a state where the substrate is supported by the substrate support portion.
Figure 3B:
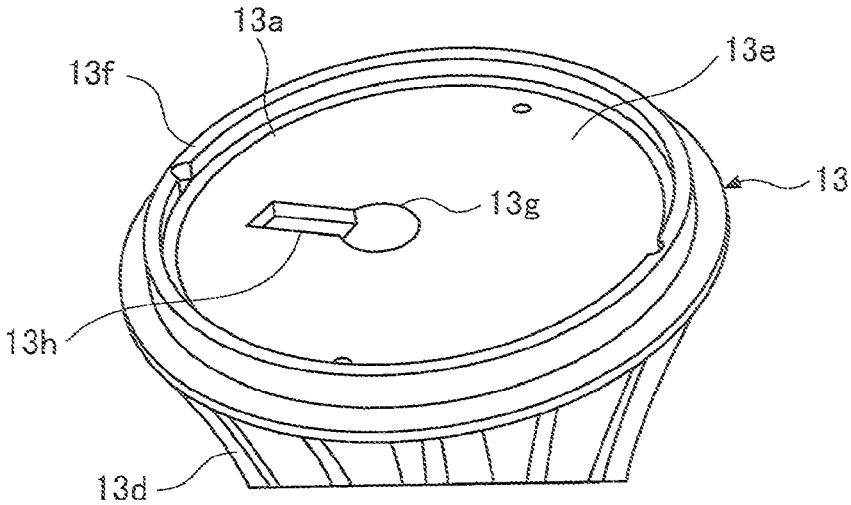
FIG. 3B shows a perspective view of a substrate support portion of the lighting device in a state where the substrate removed.

The substrate 14 is composed of a highly thermally conductive metal and is composed of a thin aluminum plate with an approximately circular shape in the embodiment. As shown in FIG. 2, a wiring pattern 14*p* composed of copper foil is formed on the surface of the substrate 14 (the upper surface in FIG. 1) with an electrical insulation layer such as silicone resin interposed between the surface of the substrate 14 and the wiring pattern 14*p*. As shown in FIG. 3A, the four LEDs 11 are mounted and disposed on the wiring pattern in an concentric circle at an approximately equal interval. Thus the four LEDs are disposed so that the LEDs 11 are approximately symmetrical with respect to the center x of the circular substrate 14. Each LED 11 is connected in series by the wiring pattern. A notch-shaped wire insertion portion 14*a* is formed at the peripheral edge of the substrate 14 by notching out the substrate 14 so that the wire insertion portion 14*a* penetrates the wiring pattern and the electrical insulation layer. The notch-shaped wire insertion portion 14*a* is a notch portion which is located approximately midway between the adjacent LEDs 11 and which has an elongated shape aligned with the longitudinal direction of the groove portion 13*h* of the substrate support portion 13*e* with a larger width dimension than that of the groove portion 13*h*.

The substrate 14 is mounted on the substrate support portion 13*e* of the main body 13 so that the substrate 14 is electrically insulated from, but is in close contact with the substrate support portion 13*e*. That is, as shown in FIG. 2, the notch-shaped wire insertion portion 14*a* is placed in an end portion of the linear groove portion 13*h*. The substrate 14 is fixed to the substrate support portion 13*e* in a closely contacted state with the substrate support portion 13*e*, which forms a flat surface, by fixing means such as a screw with an electrical insulation sheet (not shown) composed of silicone resin or like interposed between the substrate 14 and the substrate support portion 13*e*. The optical axis of a light source formed of the LEDs 11 and the substrate 14 is aligned with the central axis x-x of the main body. Thus, a light source portion having a light-emitting surface of an approximately circular shape in a plan view as a whole is formed.

The electrical connector 15 includes a small connector, and the output side terminal of the connector is connected by soldering "s," for example, to the input side of the wiring pattern 14*p* which is a wiring connecting all the LEDs 11 in series. At the same time, the connector itself is fixed and supported at a position deep inside the notch-shaped wire insertion portion 14*a* of the substrate 14. The electrical connector 15 including the connector is disposed at a position in close proximity of the wire insertion portion 14*a* of the substrate 14, and is electrically connected to each of the four LEDs 11 mounted on the surface of the substrate. The input side terminal of the connector is formed of a screwless quick connect terminal. The wire 16 to supply power which is connected to the output terminal of the power supply device 12 is inserted and connected to the quick connect terminal.

The wire 16 is inserted through the through-hole 13*g* of the main body 13 and the wire insertion portion 14*a* of the substrate 14. The wire 16 has a shape and dimensions capable of being fitted into and housed in the groove portion 13*h* so that that wire 16 does not project from the flat surface of the substrate support portion 13*e*. The wire 16 is a thin lead wire with two cores electrically insulated.

The base member 17 is formed of an Edison type E17 base. The base member 17 includes a cylindrical shell portion 17*a* which is made of copper plate and has screw threads, and an electrically conductive eyelet portion 17*c* installed to the apex of the lower end of the shell portion with an electrical insulator 17*b* interposed between the shell portion and the eyelet portion 17*c*. The base member 17 is fixed to the other end portion of the main body 13 by fitting an opening portion of the shell portion 17*a* into the base fixing portion 20*c* of the insulating case 20, while electrical insulation is provided between the base member 17 and the main body 13 by means such as caulking or bonding with adhesive such as silicone resin or epoxy resin. The shell portion 17*a* and the eyelet portion 17*c* are connected to an input line (not shown) extending from the input terminal of the circuit board 12*a* of the power supply device 12.

The cover member 18 forms a globe. The cover member 18 has a translucency, and is composed of thin glass or synthetic resins such as translucent white polycarbonate which is transparent or has light diffusibility, for example. The cover member 18 is composed of translucent white polycarbonate, has an opening 18*a* at one end, and is formed to have a smooth curved surface which is similar to the shape of a mini krypton bulb. The cover member 18 is fixed to the projecting strip portion 13*f* with adhesive such as silicone resin or epoxy resin, for example, after fitting an open end portion of the opening 18*a* into the projecting strip portion 13*f* of the substrate support portion 13*e* so that the cover member 18 covers the light-emitting surface of substrate 14. The inclined peripheral surface of the main body 13 is continuously connected to the curved peripheral surface of the cover member 18 to have an integral external appearance which is similar to the shape of a mini krypton bulb.

Now, an assembly procedure of the bulb-type lighting device 10 configured as described above is described. First, the insulating case 20 is fitted into the housing recess portion 13*c* of the main body 13, and the insertion hole 20*d* of the insulating case is aligned with the through-hole 13*g* of the main body. Then, a contacting portion between the peripheral surface of the insulating case 20 and the inner surface of the housing recess portion 13*c* is coated with adhesive to fix the insulating case 20.

Next, the wire 16 pre-connected to the output terminal of the circuit board 12*a* of the power supply device 12 runs through the insertion hole 20*d* of the insulating case 20 to the through-hole 13*g* of the main body 13, while the vertically oriented circuit board 12*a* is inserted into the insulating case 20 to fit into the guide groove. Thus, the circuit board 12*a* is supported and housed by the insulating case 20. At this point, the tip of the wire 16 is pulled out from the upper end of the through-hole 13*g* of the main body 13. Next, the wire 16 pulled out from the through-hole 13*g* is fitted into the groove portion 13*h* of the substrate support portion 13*e* along longitudinal direction of the groove portion, and the tip of wire 16 is pulled out from the tip end portion of the groove portion.

Next, the LEDs 11 are mounted and the electrical connector 15 is disposed on the substrate 14. The substrate 14 is positioned and disposed on the substrate support portion 13*e* in such a manner that the notch-shaped wire insertion portion 14*a* faces the groove portion 13*h*. The substrate 14 is fixed from the upper side (the surface side) at two positions in the peripheral area of the substrate 14 by fixing means such as screws (FIG. 3A). At this point, an insulation sheet (not shown) having a thermal conductivity and an electric insulating property may be interposed between the flat surface of the substrate support portion 13*e* and the back side of the substrate 14. The back side of the substrate 14 and the flat surface of the substrate support portion 13*e* are fixed together in a closely contacted state.

Next, the tip of wire 16 already pulled out from the groove portion 13*h* is inserted and connected to the input terminal of the electrical connector 15 through the notch-shaped wire insertion portion 14*a* of the substrate 14. At this point, connection of the wire 16 to the electrical connector 15 can be performed on the surface side of the substrate 14.

Next, an input line (not shown) leading from the input terminal of the circuit board 12*a* of the power supply device 12 is connected to the shell portion 17*a* and the eyelet portion 17*c* of the base member 17. While keeping the connection, the opening portion of the shell portion 17*a* is fitted into and bonded to the base fixing portion 20*c* of the insulating case 20 by adhesive.

Next, the cover member 18 is prepared and placed to cover the substrate support portion 13*e* of the main body 13. Then, the open end portion of the opening 18*a* is fitted into the projecting strip portion 13*f* of the main body, and a contacting portion with the projecting strip portion is coated by adhesive to fix the cover member 18.

Thus, configured is a small bulb-type lighting device 10 which include the cover member 18 as a globe in the one end portion and the type E17 base member 17 in the other end portion thereby having an external appearance resembling the shape of a mini krypton bulb, and which has a brightness equivalent to that of a 10 W mini krypton bulb.

Figure 4:
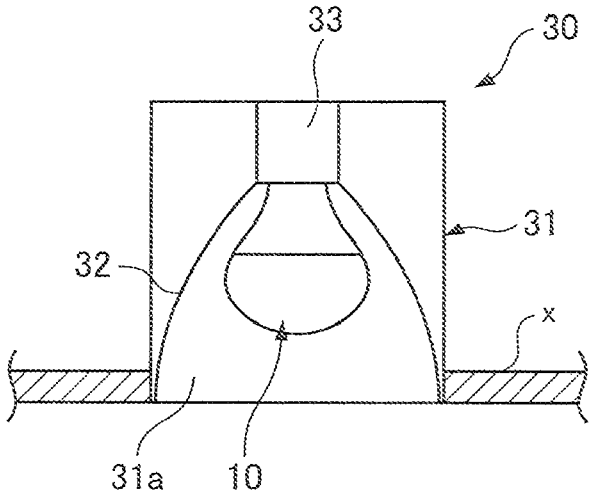
FIG. 4 shows a schematic cross-sectional view of a lighting fixture mounted with the lighting device in a state where the lighting fixture is installed to a ceiling.

Next, a configuration of a lighting fixture which uses the lighting device 10 with the above-mentioned configuration as a light source is described. As shown in FIG. 4, a lighting fixture 30 is a conventional down light type lighting fixture which uses a E17 base mini krypton bulb as a light source, and is embedded and installed in a ceiling X of a store or the like. The lighting fixture 30 is configured to include a metal fixture body 31 which has a box shape with an opening portion 31*a* on the underside of the lighting fixture 30, a metal reflector 32 which fits into the opening portion 31*a*, and a socket 33 into which an E17 base mini krypton bulb can be screwed. The reflector 32 is composed of a metal plate such as a stainless steel, for example, and the socket 33 is installed at the center portion of the top surface plate of the reflector 32.

In the conventional lighting fixture 30 for a mini krypton bulb configured as described above, the small bulb-type lighting device 10 which uses the LEDs 11 as a light source as described above is used to replace a mini krypton bulb in order to save power and achieve a longer life of the lighting device. Since the lighting device 10 has the base member 17 of E17 base, the lighting device 10 can be directly inserted into the socket 33 for a mini krypton bulb of the above-mentioned lighting fixture. The peripheral surface of the lighting device 10 is a conical tapered surface, and the external appearance of the conical tapered surface is similar to the shape of the neck portion of a mini krypton bulb. The lighting device 10 can be smoothly inserted into the lighting fixture without bumping the neck portion of lighting device 10 against the reflector 32 around the socket, thus applicability of the bulb-type lighting device 10 to conventional lighting fixture is increased. Thereby, power saving down light which uses the LEDs 11 as a light source is provided.

When a power supply to the down light configured as above is turned on, power is supplied from the socket 33 to the lighting device 10 through the base member 17 of the lighting device 10. Then, the power supply device 12 operates and direct-current voltage of 24 V is outputted. The direct-current voltage is applied to each LED 11 connected in series via the power supply wire 16 connected to the output terminal of the power supply device 12. All the LEDs 11 light up simultaneously and a white light is emitted.

When the bulb-type lighting device 10 is lit, the temperature of each LED 11 rises and heat is generated. The heat is transmitted from the substrate 14 made of aluminum to the substrate support portion 13*e* to which the substrate is fixed in a closely contacted state, and is effectively dissipated from main body 13 made of aluminum to the outside via the heat dissipation fins 13*d*.

According to the embodiment described above, four of the LEDs 11 are mounted and disposed on the surface of the substrate 14 in an concentric circle at an approximately equal interval. Thus the light emitted from each LED 11 is approximately uniformly distributed on the whole inner surface of the cover member 18, and is diffused by the translucent white globe. Consequently, lighting with a light distribution characteristic similar to that of mini krypton bulb can be achieved.

Moreover, since the electrical connector 15 is located on the peripheral edge instead of the center portion of a light-emitting portion of the substrate 14, influence on the light distribution characteristic can be avoided. Combined with the arrangement of the multiple LEDs at an approximately equal interval around the peripheral area of the substrate 14, the whole globe will approximately uniformly light up, and thereby lighting with a uniform light distribution can be achieved. In particular, the electrical connector 15 is disposed in close proximity of the wire insertion portion 14*a* provided at approximately midpoint between the adjacent LEDs 11, which is a dead space. Thus blocking of light emitted from each of the adjacent LEDs 11 due to electrical connector 15 can be prevented. Consequently, low light intensity area in the light distribution is unlikely to be formed, and lighting with further uniform light distribution can be achieved.

In particular, since the light distribution of the lighting device 10 used as a light source is similar to that of a mini krypton bulb, light emission to the reflector 32 near the socket 33 disposed in the lighting fixture 30 is increased. Thus, it is possible to obtain a fixture characteristic according to an optical design of the reflector 32 which is originally configured as a reflector for a mini krypton bulb.

The heat generated from each LED 11 is transmitted through the substrate 14 made of aluminum to the substrate support portion 13*e* to which the substrate is fixed in a closely contacted state, and is effectively dissipated from the main body 13 made of aluminum to the outside via the heat dissipation fins 13*d*. Here, since the wire 16 is housed in the groove portion 13*h* of the substrate support portion 13*e*, and is not interposed between the substrate 14 and the substrate support portion 13*e*, the substrate and the substrate support portion can be fixed together in a closely contacted state without fail.

This provides an excellent thermal conductivity, and the heat from the LEDs is effectively dissipated. Thus, temperature rise of each LED 11 and unevenness of temperatures between the LEDs 11 are prevented, and thereby, reduction of luminous efficiency is suppressed and drop of illuminance due to reduction of luminous flux can be prevented. Accordingly, a lighting device capable of producing luminous flux equal to a certain filament light bulb can be provided. At the same time, the LEDs can be made to have a longer life.

Also, the groove portion 13*h* and through-hole 13*g* to accommodate the wire 16 so that the substrate 14 can be brought into close contact with the substrate support portion 13*e* can be easily formed by machining of aluminum or the like. Thus, a cost effective lighting device can be provided. Alternatively, a method can be employed in which the substrate 14 is made from a substrate made of thin aluminum and a groove portion is formed in the substrate by press work.

In the main body 13, there is formed the through-hole 13*g* in the substrate support portion 13*e* and the groove portion 13*h* continuous with the through-hole. In the substrate 14, the notch-shaped wire insertion portion 14*a* is formed. The wire 16 to supply power is inserted through the through-hole 13*g*, the groove portion 13*h*, and the wire insertion portion 14*a* of the substrate, and is connected to the electrical connector 15. All of the works to connect the wire 16 to the electrical connector 15 can be done on the surface side of the substrate 14. Accordingly, the wiring work can be done easily, and it is possible to provide a lighting device which is easy to be manufactured and thus suitable for mass production. Cost reduction is made possible and low cost lighting devices can be achieved.

When the wiring work is done, the substrate 14 is already fixed to the substrate support portion 13*e* of the main body 13. Thus, it is not necessary to perform wiring connection work for the substrate in an unstable condition where the substrate is not fixed to the main body, which is the case with JP-A 2003-59330 (KOKAI). The wiring work can be done much easily, and it is possible to provide a lighting device which is suitable for mass production.

The embodiment requires no installation of the substrate to the main body with the wire connected, which is the case with JP-A 2003-59330 (KOKAI). Thus, it is possible to prevent wire breaking due to an external force applied to the connection portion of the wire and to prevent disconnection of the wire from the quick connect terminal. Also, the wire 16 does not project from the peripheral edge of the substrate 14. Thus, when the substrate 14 is mounted on the substrate support portion 13*e* of the main body 13, it is not necessary to secure an electrical insulation distance between the wire 16 and the main body 13. Thus, the radial dimensions of the main body 13 can be made be small, and miniaturization of the main body can be achieved.

Also, according to the configuration of the embodiment, the wire pulled out is not in contact with the substrate 14. Thus, a protective tube is not needed, and this is advantageous for cost reduction. Also simplified assembly process makes the configuration more suitable for mass production.

Furthermore, according to the embodiment, the wire 16 pulled out from the through-hole 13*g* of the main body 13 can be disposed at a predetermined position by guiding the wire 16 along the linear groove portion 13*h* as a target, the groove portion 13*h* formed continuous with the through-hole. Thus, when the wiring work is done, the target position for the wiring work can be easily identified, and improvement in productivity can also be achieved. Since the wire insertion portion 14*a* of the substrate 14 is formed with the notch-shaped portion on the peripheral edge, connection of the wire 16 to the electrical connector 15 can be made through the notch on the peripheral edge of the substrate, thereby providing further improved productivity.

The through-hole 13*g* of the main body 13 is formed so that the central axis y-y of the through-hole 13*g* is displaced outward from the central axis x-x of main body 13 by a distance of "a" in radial direction. Also, the groove portion 13*h* is formed so as to be continuous with the through-hole 13*g* and to extend outward linearly in the radial direction. Thus, the length of the wire running can be reduced to a minimum, and this is advantageous for cost reduction.

Figure 5A:
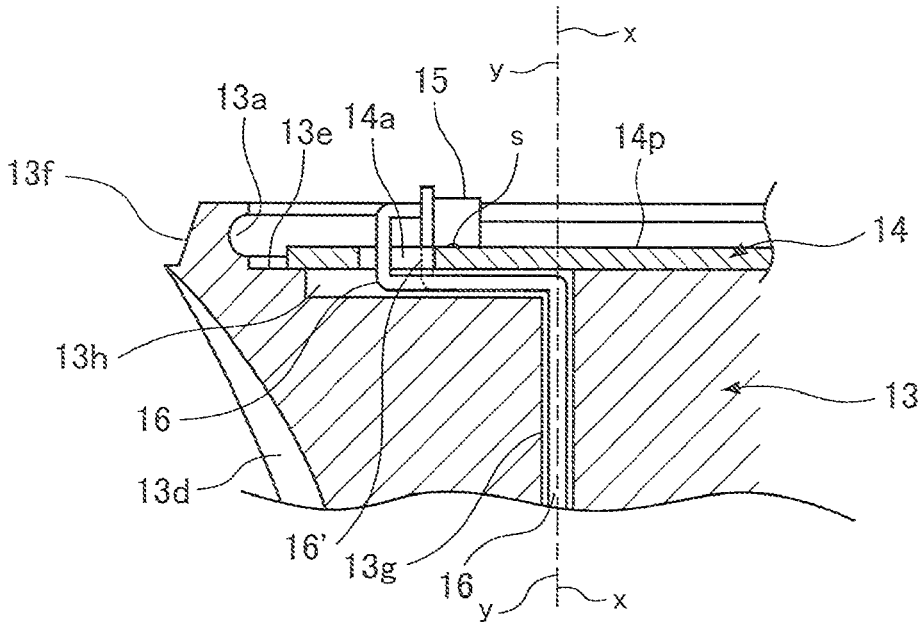
FIG. 5A shows an enlarged cross-sectional view of a substrate support portion of a lighting device according to a modification.

In the embodiment above, the through-hole 13*g* of the main body 13 is formed so that the central axis y-y of the through-hole 13*g* is displaced outward from the central axis x-x of the main body 13 by a distance of "a" in the radial direction. However, as shown in FIGS. 5A and B, the through-hole 13*g* may be formed so that the central axis y-y of the through-hole 13*g* approximately matches the central axis x-x of the main body 13. Moreover, as shown in FIGS. 5A and B, the wire insertion portion 14*a* of the substrate 14 may be formed by a relatively large through-opening instead of a notch so that the electrical connector 15 can be disposed at a position closer to the central portion of the substrate support portion 13*e*. Accordingly, since the electrical connector 15 can be disposed at a position closer to the through-hole 13*g*, the length of the wire 16 can be further reduced. Also, as shown by a dotted line in FIG. 5A, an input side terminal including a quick connect terminal may be provided under the electrical connector 15 so that the wire 16' is connected from the lower side of the connector. Thus the length of the wire can be further reduced.

Figure 5B:
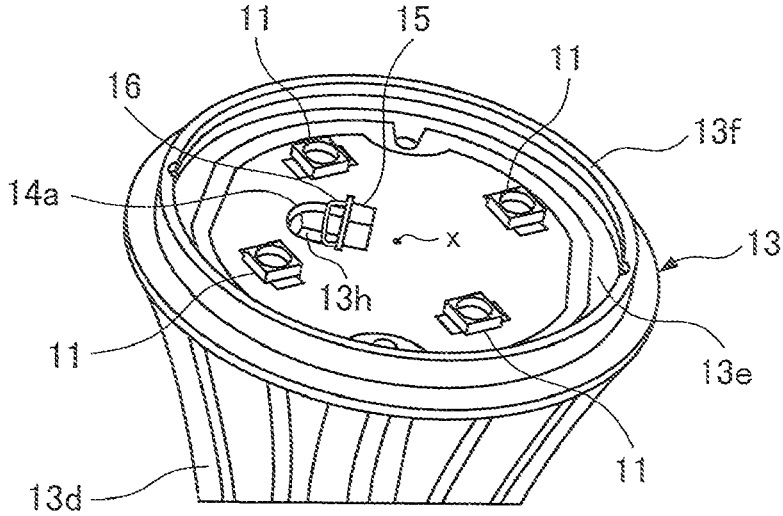
FIG. 5B shows a perspective view of the substrate support portion of a lighting device according to the modification in a state where the substrate is supported by the substrate support portion.
Figure 6A:
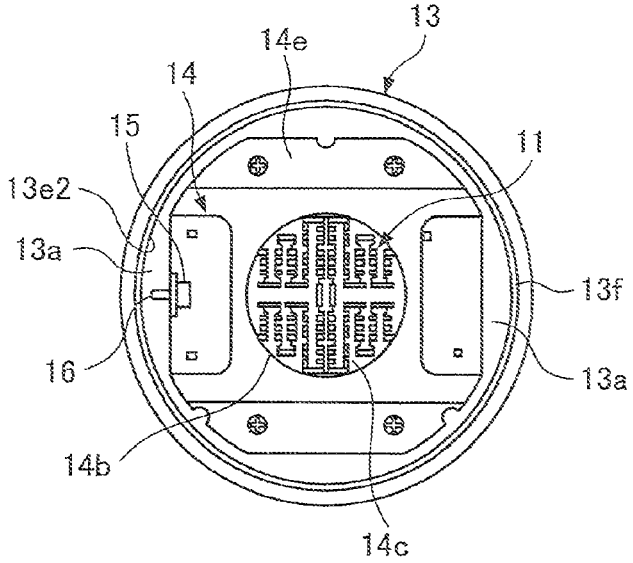
FIG. 6A shows a top view of a lighting device according to a second embodiment of the invention in a state where a cover is removed.
Figure 6B:
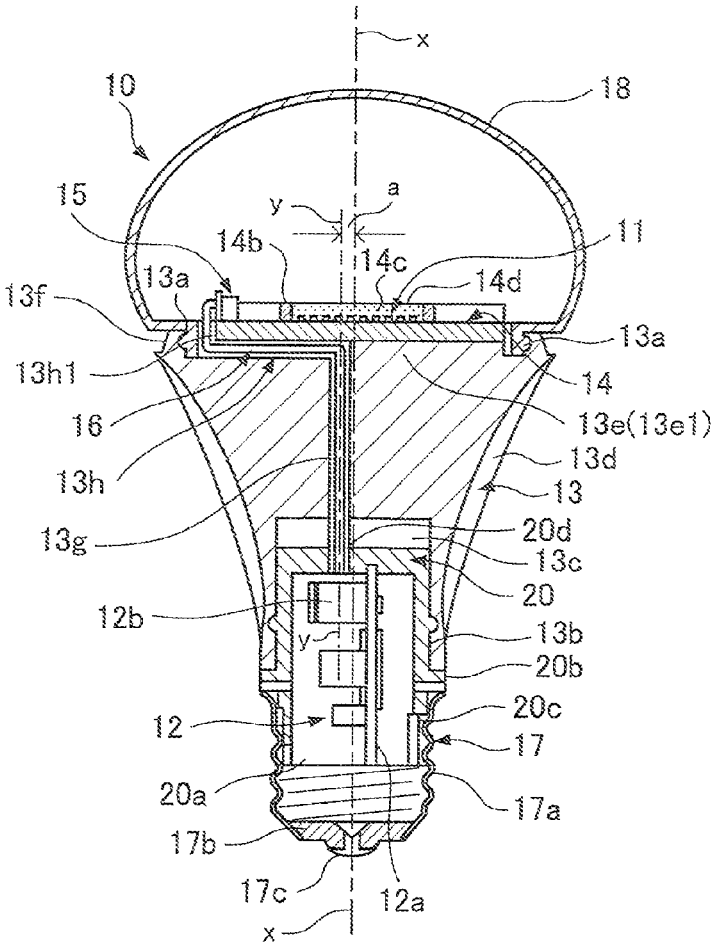
FIG. 6B shows a longitudinal cross-sectional view of the lighting device according to a second embodiment of the invention.

In the main body 13, asperities or satin-like pattern, for example, may be formed on the outer surface portion exposed to the outside to increase the surface area, or white coating or white alumite treatment may be applied to the outer surface portion to increase the thermal emissivity of the outer surface portion. When the bulb-type lighting device 10 to which white coating or white alumite treatment has been applied is mounted on the lighting fixture 30, and is lit, the reflectivity of the aluminum outer surface of the main body 13 exposed to the outside becomes higher. Thus, the lighting efficiency of the fixture can be increased. In addition, the appearance and design of the lighting device becomes better, thereby increasing marketability of the lighting device. Also, the cover member may be formed by using a transparent or semi-transparent protective cover which protects a live portion for the light-emitting diodes and the like from the outside environment. In FIGS. 5A, 5B showing a modification of the embodiment, the same portions as those in FIGS. 1 to 4 are labeled with the same reference numerals, and the detailed descriptions for the portions are omitted.

Second Embodiment

In the embodiment, LEDs using Chip on Board (COB) technology is used instead of Surface Mount Device (SMD) type LEDs. Multiple LED chips are mounted on a substrate in an approximate matrix form. A light-emitting module including the substrate and LEDs is configured to be small in size. Creation of multiple shadows by light of the bulb is avoided while achieving miniaturization of the lighting device.

A lighting device according to the embodiment is a lighting device 10 having a small-bulb-type similar to a mini krypton bulb, as is the case with the first embodiment. As shown in FIGS. 6A to 8B, a substrate 14 is a thin aluminum plate of an approximately square shape with four corners trimmed. A bank portion 14*b* having an approximately circular inner peripheral surface and a shallow circular housing recess portion 14*c* are formed on the surface side of the substrate 14. A wiring pattern composed of copper foil is formed on the bottom surface of the housing recess portion 14*c*. On the substrate 14, multiple LED chips 11 (blue LED chips) are mounted by using COB technology in an approximate matrix form adjacent to the wiring pattern in the housing recess portion 14*c* of the substrate. The LED chips 11 arranged regularly in an approximate matrix form are connected in series by the adjacent wiring pattern and bonding wires.

The housing recess portion 14*c* of the substrate 14 formed as mentioned above is coated or filled with a sealing member 14*d* in which yellow phosphor is dispersed and mixed. The sealing member 14*d* transmits blue light emitted from blue LED chip 11 mentioned above, and also emits yellow light by exciting the yellow phosphor with the blue light. Then the blue light and the yellow light are mixed to form white light. The white light is emitted on a support portion 14*e*. The support portion 14*e* is a member which is formed integrally with the substrate 14 at both ends of the substrate 14 to support the substrate 14 at a substrate support portion 13*e* of a main body 13.

A substrate support portion 13*e* is formed integral with the main body 13 at an opening portion 13*a* in a one end portion in the main body 13, the substrate support portion 13*e* formed as a stepped portion projecting to one end portion side of the main body and having a shape of a pedestal. A circular pedestal-shaped projecting portion 13*e*1 which has a flat surface is formed integral with the substrate support portion in a manner projecting to the one end portion side of the opening portion 13*a* of the main body. The pedestal-shaped projecting portion 13*e*1 has enough height to allow a groove portion 13*h* to be formed in which a wire 16 to supply power can be inserted. The surface of substrate support portion 13*e* surrounded by the stepped portion is formed to have an area approximately the same as that of the substrate 14 to achieve better heat conduction with the substrate 14 on which the LEDs 11 are mounted.

Also, a through-hole 13*g* penetrating the main body 13 from a center portion of the substrate support portion 13*e* to an opening portion 13*b* in the other end portion is formed in the main body 13, as similar to the first embodiment. The approximately linear groove portion 13*h* is formed integrally with the main body 13 in such a manner that one end of the groove portion 13*h* is continuous with the through-hole 13*g*, and the other end of the groove portion 13*h* has opening portion 13*h*1 opened in a peripheral edge 13*e*2 of the substrate support portion 13*e*. The width and depth of the groove portion 13*h* are determined so that the wire 16 to supply power can be fitted into and housed in the groove portion 13*h* thereby not projecting from the surface of the projecting portion 13*e*1.

Figure 7A:
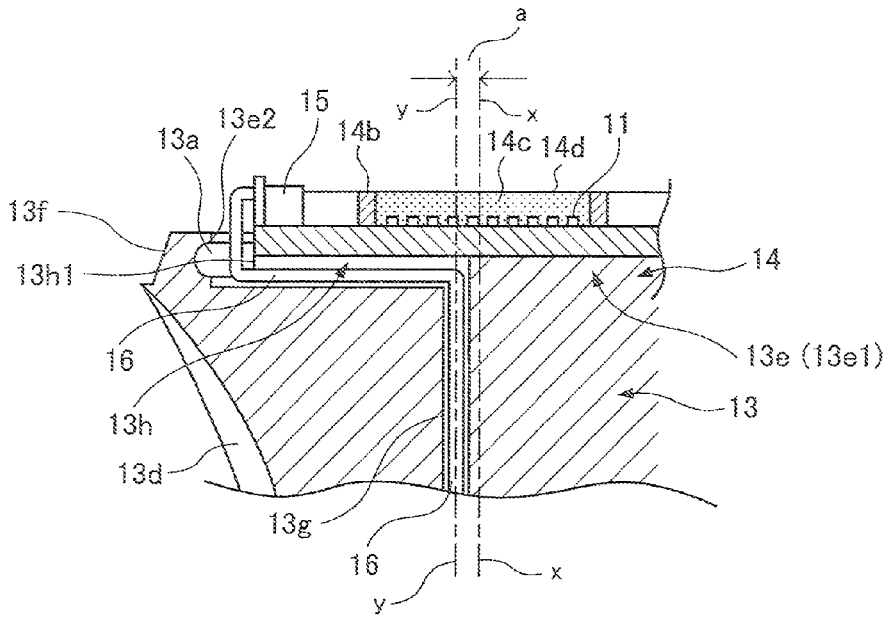
FIG. 7A shows an enlarged cross-sectional view of a substrate support portion of the lighting device.
Figure 8A:
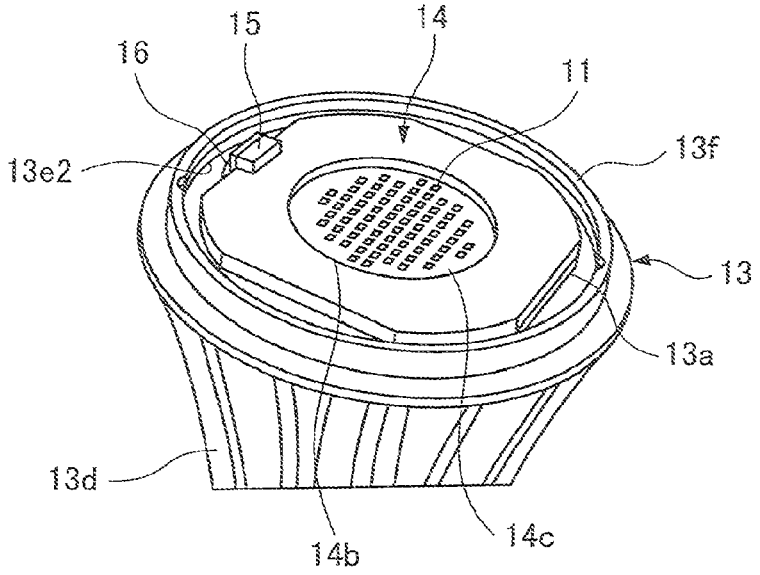
FIG. 8A shows a perspective view of a substrate support portion of the lighting device in a state where a substrate is supported by the substrate support portion.

The wire 16 is inserted and fitted into the groove portion 13*h* configured as above in the following manner. As shown in FIG. 7A, the wire 16 pulled out from the through-hole 13*g* is fitted into the groove portion 13*h* of the substrate support portion 13*e* in the longitudinal direction of the groove portion, and the tip of the wire 16 is pulled out from the opening portion 13*h*1 of the groove portion. As shown in FIG. 8A, the substrate 14 on which the LEDs 11 are mounted is disposed in such a manner that the electrical connector 15 faces the opening portion 13*h*1 of the groove portion 13*h*, and is fixed at two positions from the upper side (the surface side) by fixing means such as a screw.

Figure 7B:
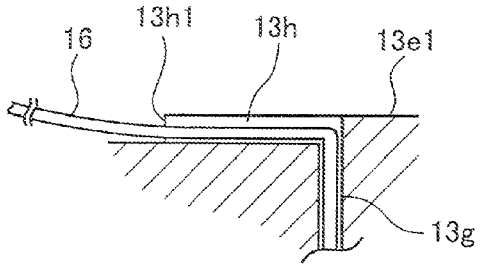
FIG. 7B is an enlarged cross-sectional view showing a state where a wire is inserted in a groove portion, but is not connected to an electrical connector yet.
Figure 7C:
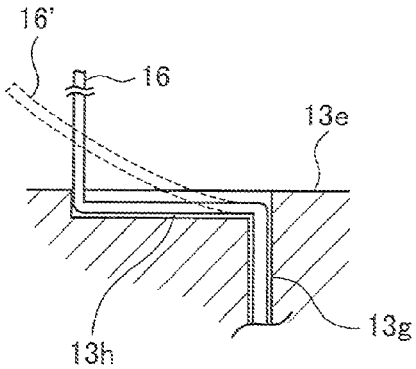
FIG. 7C is an enlarged cross-sectional view showing a state in the first embodiment which corresponds to the state shown in FIG. 7B.

Then, the tip of the wire 16 already pulled out from the opening portion 13*h*1 of the groove portion 13*h* is bend back, and then inserted and connected to the electrical connector 15 provided on the peripheral edge of the substrate 14. As shown in FIG. 7B, it is only required to insert the wire 16 into the groove portion 13*h* from the above while using the groove as a target and to pull out the wire 16 to the left from the opening portion 13*h*1. In the first embodiment, since the groove portion 13*h* is formed by forming a groove in the flat surface of substrate support portion 13*e*, the wire is bent at an approximately right angle at the end of the groove as shown in FIG. 7C. Due to this design, a restoring force always acts on the wire 16, and the wire 16 may jump out of the groove upward as shown by a dotted line 16' in FIG. 7C. For this reason, when the substrate 14 is to be supported by the substrate support portion 13*e*, there is a possibility that the wire may become caught between the substrate 14 and the substrate support portion 13*e*. To counter this, connection work needs to be done while pressing down the wire. This makes the work more difficult to perform.

On the other hand, in the embodiment, as shown in FIG. 7B, the groove portion 13*h* is formed in the pedestal-shaped projecting portion 13*e*1 projecting from the opening portion 13*a* of the main body. Thus, the wire 16 is not bent at a right angle at the end of the groove portion, i.e., at the opening portion 13*h*1. This prevents the wire from jumping out of the groove portion, and the wire is not caught between the substrate 14 and the substrate support portion 13*e*. As a result, the connection work can be done without pressing down the wire, and the work can be performed more easily.

Accordingly, it is possible to design a lighting device which can be produced with high working efficiency and is suitable for mass production. The substrate 14 can be in close contact with substrate support portion 13*e* securely while being supported by the substrate support portion 13*e*. Thus, heat of the LEDs 11 is efficiently transmitted from the substrate 14 to the substrate support portion 13*e* and is effectively dissipated from the main body 13. As a result, reduction of luminous efficiency of the LEDs is suppressed and predetermined luminous flux can be obtained.

Also, in the embodiment, the multiple LED chips are mounted on the substrate in an approximate matrix form by using COB technology and the light-emitting module including the substrate 14 and the LEDs 11 is designed to be small in size. Thus miniaturization of the lighting device can be achieved. The LED chips can be densely mounted and two-dimensional light source can be configured. Thus creation of multiple shadows can be avoided.

Four LEDs, for example, are mounted and disposed on a plate-shaped substrate at an approximately equal interval as for SMD type LED. Thus, the closer the distance from a light source is, the more shadows are created by the light of a lamp. This makes SMD type LED unsuitable for use as a light source of a lamp for desk lighting. In contrast, in the second embodiment, two-dimensional light source can be configured by using COB technology, and also the lamp center and the center of the light-emitting portion can be approximately aligned. Thus, creation of multiple shadows can be avoided and the embodiment can be used as a light source of a lamp for desk lighting and the like.

Figure 8B:
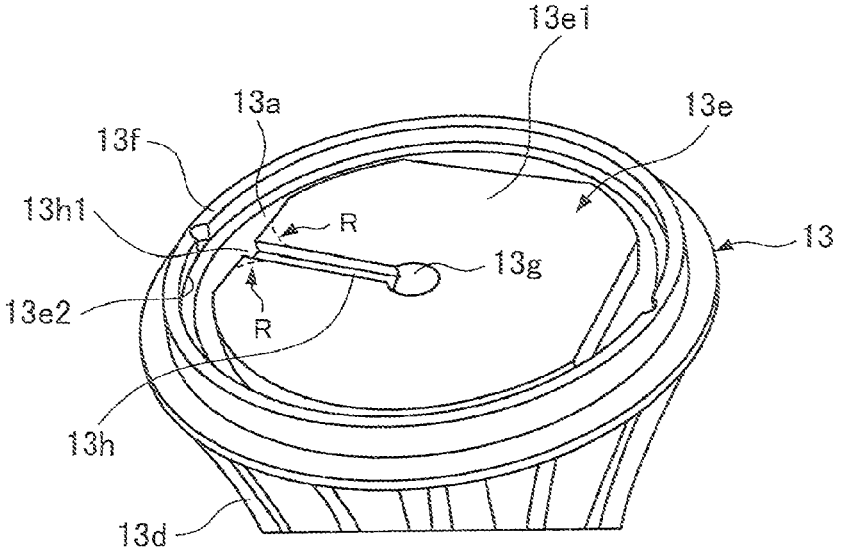
FIG. 8B shows a perspective view of a substrate support portion of the lighting device in a state where the substrate removed.

As shown by a dotted line in FIG. 8B, the corners of the opening portion 13*h*1 of the groove portion 13*h* may be rounded in such a manner that the opening portion 13*h*1 gradually expands toward the peripheral edge 13*e*2 of the substrate support portion 13*e*. These rounded corners may serves as a guide or protection of covering when the wire 16 is connected to the electrical connector 15.

Figure 9A:
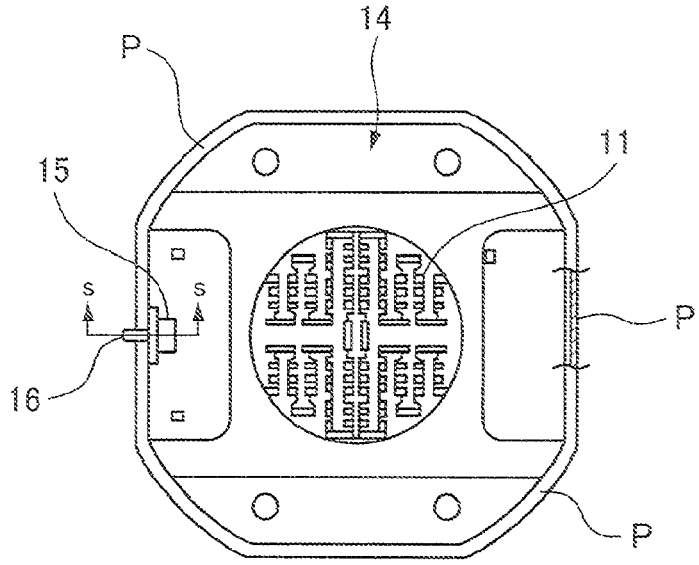
FIG. 9A shows a top view of a lighting device according to a modification with a portion of the substrate notched.
Figure 9B:
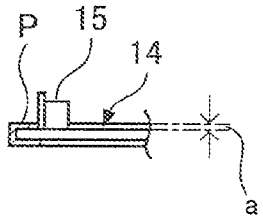
FIG. 9B shows a partial cross-sectional view of the lighting device according to the modification taken along the line s-s of FIG. 9A.

As shown in FIGS. 9A to 9E, a protecting member P having an electrical insulation property may be provided around the peripheral edge portion of the substrate 14 to protect the wire 16. As shown in FIG. 9A, the protecting member P is formed of a ring-shaped silicone resin having an approximately the same circumference as that of the peripheral edge portion of the substrate 14. The cross-sectional shape of the protecting member is formed into an approximately square U shape as shown in FIG. 9B, and is fitted into the peripheral edge portion of the substrate 14 while further opening the groove portion of the square U shape by taking advantage of the flexibility of the silicone resin. Thereby, the protecting member P is detachably attached to the peripheral edge portion of the substrate 14.

According to the configuration, when the wire 16 pulled out from the opening portion 13*h*1 of the groove portion 13*h* is bent back to be connect to the electrical connector 15, the covering of the wire 16 can be protected because the peripheral edge portion of substrate 14 is covered by the protecting member thereby eliminating exposed aluminum portion. Thus, electric leakage due to damage of the covering can be prevented. At the same time, a sufficient creeping distance between the wire 16 and the substrate 14 is secured, and thus a short circuit due to an insufficient electrical insulation can be prevented. Particularly, as shown in FIG. 9B, since the protecting member P has a square U shape cross-section, and projects upward from the surface of the substrate by a distance of "a," a sufficient creeping distance can be secured for sure. Since the protecting member P is detachably and attachebly supported on the substrate, the protecting member P can be easily removed when it is not required in a design specification.

Figure 9C:
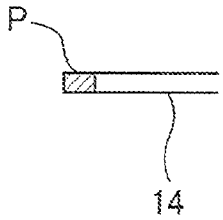
FIG. 9C shows a partial cross-sectional view of a protecting member according to another modification, which corresponds to the state shown in FIG. 9B.

The protecting member P may be fixed with an adhesive to the peripheral edge portion of the substrate 14. The protecting member may also be formed in a ring having a rectangular cross-section of an approximately the same thickness as that of the substrate 14 instead of the square U shaped cross-section, as shown in FIG. 9C, and be fixed with an adhesive to the peripheral edge portion of the substrate 14. In this case as well, a sufficient creeping distance between the substrate 14 and the wire 16 can be secured.

Figure 9D:
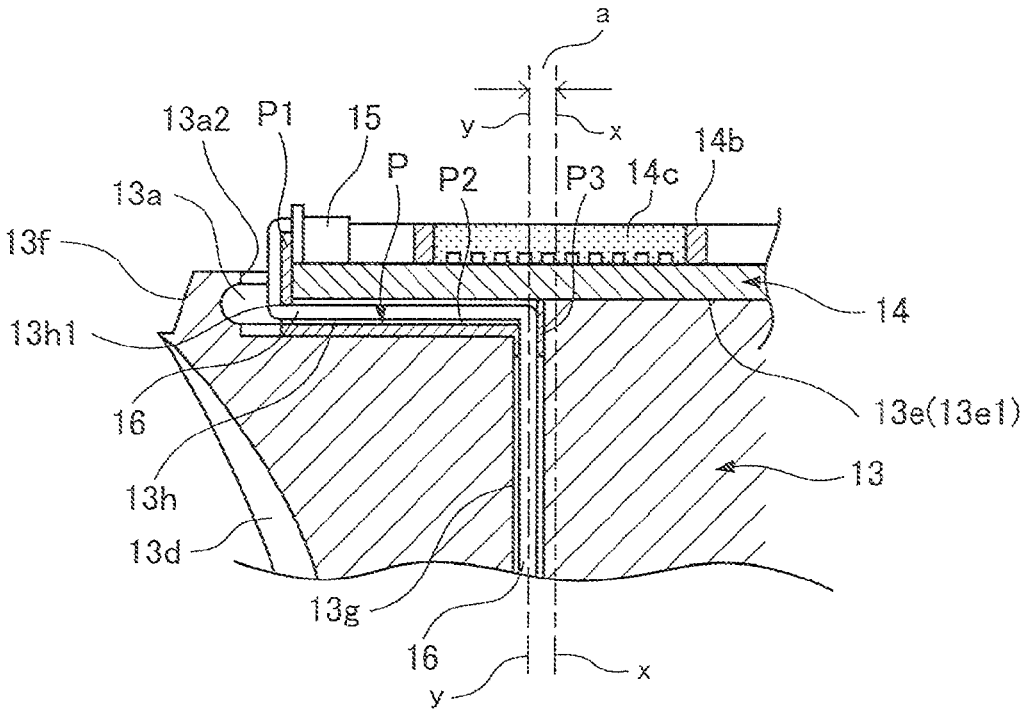
FIG. 9D shows an enlarged cross-sectional view of a substrate support portion of yet another modification.
Figure 9E:
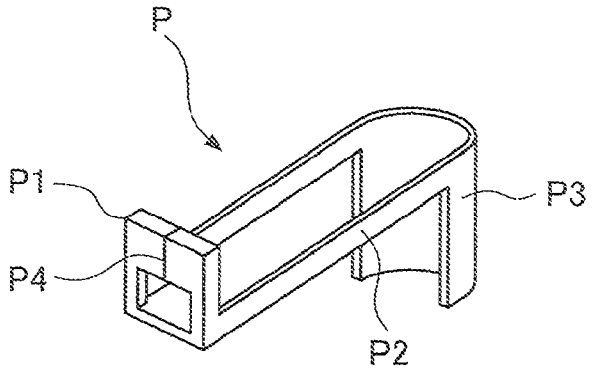
FIG. 9E shows an enlarged perspective view of a protecting member shown in FIG. 9D.

As shown in FIG. 9D, the protecting member P may be provided to extend to the groove portion 13*h* and the through-hole 13*g* to continuously cover the groove portion 13*h* and the through-hole 13*g*. Specifically, as shown in FIG. 9E, the protecting member P may be integrally formed of a opening cover portion P1, a groove cover portion P2, and a hole cover portion P3 by using silicone resin, and is supported in such a manner that the opening cover portion P1 is in contact with the opening portion 13*h*1, the groove cover portion P2 is fitted into the groove portion 13*h*, and the hole cover portion P3 is inserted and fitted into the through-hole 13*g*. The opening cover portion P1 is provided with a longitudinal cut P4 so that the wire 16 can be inserted through the cut P4 from above.

According to the configuration, the wire 16 can be protected from a corner of the through-hole 13*g*, a hard metal portion in the groove portion 13*h*, and the peripheral edge portion of the substrate 14. Thus, electric leakage due to damage of the covering can be securely prevented. Furthermore, a sufficient creeping distance can be secured between the aluminum through-hole 13*g*, groove portion 13*h*, and substrate 14, and the wire 16 disposed along these. Thus a short circuit due to an insufficient electrical insulation can be more securely prevented.

Other configurations, assembly procedures, operations, operational effects, modifications and the like of the embodiment are the same as those of the first embodiment. In FIGS. 9A to 9E showing a modification of the embodiment, the same portions as those in FIGS. 6A to 8B are labeled with the same reference numerals, and the detailed descriptions for the portions are omitted.

In the invention, the lighting device may be formed as a bulb-type lighting device (A or PS type) which is similar to the shape of a common filament light bulb, a spherical bulb-type lighting device (G type), a cylindrical bulb-type lighting device (T type), or a reflector shaped bulb-type lighting device (R type). In addition, the lighting device may be formed as a globeless bulb-type lighting device. The invention can be applied not only to lighting devices which are similar to the shape of a common filament light bulb, but also to other lighting devices with various external appearances and applications.

In the invention, a semiconductor light-emitting device may be a light-emitting device having a light source of a semiconductor such as light-emitting diode or a semiconductor laser. In the invention, the lighting device preferably includes multiple semiconductor light-emitting devices. A necessary number of semiconductor light-emitting devices can be selected according to an application of lighting. For example a group may be formed of four devices, for example, and one of the group or multiple numbers of the groups may constitute the lighting device. Moreover, a single semiconductor light-emitting device may constitute the lighting device. The semiconductor light-emitting devices may be of a SMD (Surface Mount Device) type. All or a part of the semiconductor light-emitting devices may be mounted in a certain regular pattern such as matrix, staggered, or radial arrangement by using COB (Chip On Board) Technology. The semiconductor light-emitting devices are preferably configured to emit white light. According to an application of the lighting fixture, the semiconductor light-emitting devices may be constituted of red, blue, or green light-emitting devices, or a combination of light-emitting devices of various colors.

The main body is preferably composed of a highly thermally conductive metal in order to improve the heat dissipation of the semiconductor light-emitting devices, the metal containing at least one of aluminum (Al), copper (Cu), iron (Fe), or nickel (Ni), for example. In addition to this, the main body may also be composed of industrial materials such as aluminum nitride (AlN) and silicon carbide (SiC). Furthermore, the main body may also be composed of synthetic resins such as highly thermally conductive resins. In order to improve applicability to the existing lighting fixtures, the external appearance of the main body is preferably formed similar to the shape of the neck portion of a common filament light bulb, in which cross sectional diameter gradually increases from one end portion to the other end portion. However, resembling the shape of a common filament light bulb is not a requirement herein, and the invention is not limited to specific external appearances. The substrate support portion at the one end portion of the main body preferably has a flat surface to be in close contact with and to support the substrate on which the semiconductor light-emitting devices are disposed. However, the surface is not required to be flat. As long as the substrate can be in close contact with the substrate support portion by a highly thermally conductive adhesive or the like, the substrate support portion may include a surface with asperities.

The through-hole, which penetrates the main body from the one end portion to the other end portion, is preferably formed at an approximately central portion of the substrate support portion in the substrate support portion, but may be formed at a position displaced from the central portion outward to the peripheral portion, or even in the peripheral portion. Any hole passing through from the one end portion to the other end portion of the main body is allowed. The groove portion, which is continuous with the through-hole, is preferably formed as an approximately linear groove extending outward in the radial direction of the substrate support portion from the through-hole from a perspective of wiring. However, the groove portion may be a curved groove extending in a rotational direction about the through-hole.

The substrate is a member for disposing semiconductor light-emitting devices being a light source and is preferably composed of a highly thermally conductive metal such as aluminum, copper, stainless steel, for example. Preferably, a wiring pattern is formed on the surface of the substrate with an electrical insulation layer such as silicone resin interposed between the wiring pattern and the surface of substrate, and the semiconductor light-emitting devices are mounted and disposed on the wiring pattern. However, the configuration of the substrate and means to mount the semiconductor light-emitting devices are not limited to a specific configuration or means. The material of the substrate may be a non-metallic member'composed of synthetic resins such as epoxy resin and glass epoxy material, paper phenol material or the like, for example. Moreover, the material may be ceramics. The shape of the substrate may be a plate, circle, polygonal such as, quadrilateral, hexagonal, or elliptical in order to form a point or two-dimensional module. All kinds of shapes are allowed to obtain the desired light distribution characteristic.

The electrical connector is a connector used to connect the wire which supplies power to the semiconductor light-emitting devices disposed on the substrate. Connection to the semiconductor light-emitting devices may be made by connecting the wire to the wiring pattern formed on the substrate by use of the connector, or by directly connecting the wire to the wiring pattern by means such as soldering or screwing. Furthermore, the wire may also be directly connected to the semiconductor light-emitting devices without using a wiring pattern.

The power supply device may include a lighting circuit which converts AC 100V into DC 24V to supply the DC 24V to the light-emitting device, for example. The power supply device may have a light control circuit to control the light of the semiconductor light-emitting devices. Furthermore, the wire may also be directly connected to the semiconductor light-emitting devices without using the wiring pattern. The electrical connector is preferably disposed close to and faces the wire insertion portion of the substrate so that the wire inserted through the wire insertion portion can be connected to the electrical connector immediately. However, the electrical connector is not required to be disposed close to the wire insertion portion, and may be disposed at a predetermined position away from the wire insertion portion.

The wire is means to supply an output of the power supply device to the semiconductor light-emitting devices, and any wire such as a lead wire is allowed as long as the wire has a shape and dimensions that can be housed in the through-hole of the main body and the groove portion continuous with the through-hole.

Any base can be used as the base member as long as the base member can be installed into a socket into which a common filament light bulb is installed. However, most common base in general such as Edison type E17 or E26 base is suitable. The base is not limited to specific one with a specific material, and includes a base entirely composed of metal, a resin base whose electrical connecting portion is composed of a metal such as a copper plate and the other portions are composed of synthetic resin, a base having a pin-shaped terminal used for a fluorescent lamp, and a base having a L-shaped terminal used for a ceiling rose.

In the invention, the shape of the notch-shaped wire insertion portion formed at a peripheral edge of the substrate is not limited to specific one, and includes elongated hole-shape, circular hole-shape, rectangular hole-shape, and the like. The notch preferably has a larger width dimension than that of the groove portion in order to perform a wiring work.

The electrical connector is preferably disposed close to and faces the wire insertion portion of the substrate so that the wire inserted through the wire insertion portion can be connected to the electrical connector immediately. However, the electrical connector is not required to be disposed close to the wire insertion portion, and may be disposed at a predetermined position away from the wire insertion portion.

The wire is means to supply an output of the power supply device to the semiconductor light-emitting devices, and any wire such as a lead wire can be used as long as the wire has a shape and dimensions that can be inserted through the through-hole of the main body and the wire insertion portion of the substrate, and that can be housed in the groove portion.

In the invention, the substrate support portion formed by the stepped portion has a height at least sufficient to form a groove in which the wire can be inserted, and the surface of the substrate support portion surrounded by the stepped portion has the same or larger surface area than that of the substrate on which the semiconductor light-emitting devices are mounted to achieve better heat conduction to the substrate. This is preferable in order to achieve miniaturization of the lighting device and predetermined luminous flux. The shape of stepped portion which has such a height and surface area can be substantially any shape selected for a design.

In the invention, the protecting member may be composed of silicone resin, synthetic resin such as nylon, or synthetic rubber which has flexibility. The protecting member may be provided to entire peripheral edge portion of the substrate, or only to a portion facing the groove opening from which the wire is pulled out. At the opening, the protecting member may include a projecting portion which projects outward from the circumference of the opening so that the wire is detoured along the projecting portion to be connected to the electrical connector. Thus, the creeping distance is increased to secure an electrical insulation distance between the wire and the substrate. The protecting member may also be provided to extend from the peripheral edge portion of the substrate to the groove and the through-hole for continuous covering. The protecting member may be integrally formed with the peripheral edge portion of the substrate, or may be formed separately from the peripheral portion of the substrate so as to be attached detachably.

In the invention, the lighting fixture may be ceiling flush type, direct mounting type, pendant type, or wall mounting type. The fixture body may be mounted with a globe, a shade, a reflector as a light control body or a lighting device being the light source may be exposed in the fixture body. The fixture body may be mounted with not only a single lighting device, but also multiple lighting devices. The lighting fixture may be a large size lighting fixture for facility and industrial use which is used in an office or the like.

Preferred embodiments of the invention have been described above. However, the invention is not limited to the embodiments described above, and various design modifications can be made without departing from the spirit of the invention.

What is claimed is:

1. A lighting device comprising:

a thermally conductive main body having a substrate support portion in one end portion, and having a through-hole portion formed in the substrate support portion and a groove portion formed in the substrate support portion, the through-hole portion penetrating from the one end portion to the other end portion of the main body in a first direction, the groove portion extending continuously from the through-hole portion at one end of the groove portion in a second direction substantially perpendicular to the first direction to another end of the groove portion;

a substrate mounted with a semiconductor light-emitting device, and disposed on the substrate support portion of the main body;

an electrical connector disposed on one end portion of the substrate and connected to the semiconductor light-emitting device;

a power supply device housed in the main body and configured to light the semiconductor light-emitting device;

a wire having one end connected to the power supply device and the other end connected to the electrical connector while being inserted through the through-hole and the groove portion of the main body; and a base member provided in the other end portion of the main body and connected to the power supply device; wherein a notch-shaped wire insertion portion is formed in a peripheral edge of the substrate;

the substrate is disposed on the substrate support portion of the main body in such a manner that the notched-shaped wire insertion portion faces the groove portion and the substrate covers the through-hole and the groove portion except at the other end of the groove portion; and the wire is bent at the other end of the groove portion.

2. The lighting device according to claim 1, wherein the substrate support portion is formed as a stepped portion projecting to the one end portion side.

3. The lighting device according to claim 1. wherein the substrate is provided with a protecting member at least in a peripheral edge portion facing the wire, the protecting member having an electrical insulation property.

4. A lighting fixture comprising: a fixture body provided with a socket; and the lighting device according to claim 1 attached to the socket of the fixture body.

5. The lighting device according to claim 1, wherein the lighting device is any one of: a bulb-type lighting device (A or PS type) which is similar to the shape of a common filament light bulb; a spherical bulb-type lighting device (G type); a cylindrical bulb-type lighting device (T type); a reflector-shaped bulb-type lighting, device (R type); and a globeless bulb-type lighting device.

6. The lighting device according to claim 1, wherein the semiconductor light-emitting device is a light-emitting-device using, as a light source, any one of a light-emitting diode and a semiconductor of a semiconductor laser.

7. The lighting device according to claim 1. wherein the semiconductor light-emitting device includes any one of a single device, a plurality of devices, a group of devices and a plurality of groups of devices.

8. The lighting device according to claim 1, wherein a part of or all of the semiconductor light-emitting devices are mounted in a certain regular pattern such as any one of a matrix, staggered, or radial arrangement pattern by using any one of surface mount device (SMD) type and chip on board (COB) technology.

9. The lighting device according to claim 1, wherein the semiconductor light-emitting device may include any one of a white, red, blue and green device, and any combination of the white, red, blue and green devices according to an application of the lighting fixture.

10. The lighting device, according to claim 1. wherein the main body is composed of a highly thermally conductive metallic material.

11. The lighting device according to claim 1, wherein the main body is composed of a material including at least one of: aluminum (Al), copper (Cu), iron (Fe), nickel (Ni), aluminum nitride (AIN), silicon carbide (SiC), and a synthetic resin.

12. The lighting device according to claim 1, wherein the substrate support portion in the one end portion of the main body includes a flat surface on which the substrate mounted with the semiconductor light-emitting device is supported in close contact with the substrate support portion.

13. The lighting device according to claim 1, wherein the through-hole portion penetrating from the one end portion to the other end portion side in the substrate support portion is formed at an approximately central portion of the substrate support portion.

14. The lighting device according to claim 4, wherein the lighting fixture is any one of a ceiling flush type, a direct mounting type, a pendant type, and a wall mounting type.

15. The lighting device according to claim 1, wherein the through-hole portion penetrating from the one end portion to the other end portion side in the substrate support portion is formed at a position displaced from a central portion of the substrate support portion outward in a radial direction.

16. The lighting device according to claim 1, wherein the groove portion extending continuously from the through-hole portion is formed as an approximately linear groove extending from the through-hole portion outward in a radial direction of the substrate support portion.

17. The lighting device according to claim 1, wherein the groove portion extending continuously from the through-hole portion is formed as a curved groove extending in a rotational direction about the through-hole.

18. The lighting device according to claim 1, wherein the substrate is composed of a material including at least one of: aluminum, copper, stainless steel, synthetic resin, glass epoxy material, and paper phenol material.

19. The lighting device according, to claim 1, wherein the substrate is formed in any one of a polygonal shape and an elliptical shape.

20. The lighting device according to claim 1, wherein the electrical connector is disposed on the one end portion of the substrate near the notched-shaped wire insertion portion.

21. The lighting device according to claim 1, wherein the wire is pulled out of the one end portion of the substrate from the groove portion and the notched shaped wire insertion portion and bent back.

* * * * *